US008768203B2

(12) United States Patent
Hamada et al.

(10) Patent No.: US 8,768,203 B2
(45) Date of Patent: Jul. 1, 2014

(54) IMAGE FORMING APPARATUS CAPABLE OF EFFECTIVELY UTILIZING INTERIOR SPACE

(75) Inventors: Manabu Hamada, Osaka (JP); Tomofumi Yoshida, Osaka (JP); Hirobumi Ooyoshi, Osaka (JP); Yoshiyuki Shimizu, Hyogo (JP); Takeru Muramatsu, Osaka (JP); Tomohiro Kubota, Osaka (JP); Shinichi Arasawa, Osaka (JP); Shoh Tsuritani, Osaka (JP); Masanari Fujita, Osaka (JP); Tatsuo Fukushima, Osaka (JP); Nobuhiko Kita, Osaka (JP); Haruo Hashimoto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 291 days.

(21) Appl. No.: 13/290,607

(22) Filed: Nov. 7, 2011

(65) Prior Publication Data

US 2012/0114373 A1 May 10, 2012

(30) Foreign Application Priority Data

Nov. 8, 2010 (JP) ..... 2010-249758
Jul. 15, 2011 (JP) ..... 2011-156743
Sep. 9, 2011 (JP) ..... 2011-197186

(51) Int. Cl.
*G03G 15/00* (2006.01)

(52) U.S. Cl.
USPC ..... 399/110

(58) Field of Classification Search
USPC ..... 399/107, 110–119
See application file for complete search history.

(56) References Cited

U.S. PATENT DOCUMENTS 7,457,564 B2 * 11/2008 Takami ..... 399/120
7,606,518 B2 * 10/2009 Koyama ..... 399/258
7,965,958 B2 6/2011 Tatsumi et al.
8,019,259 B2 9/2011 Ooyoshi et al.

(Continued)

FOREIGN PATENT DOCUMENTS

CN 101105664 1/2008
JP 03-126961 A 5/1991

(Continued)

OTHER PUBLICATIONS

Chinese Office Action dated Sep. 12, 2013.

(Continued)

*Primary Examiner* — Hoan Tran
(74) *Attorney, Agent, or Firm* — Harness, Dickey & Pierce, P.L.C.

(57) ABSTRACT

An image forming apparatus includes an exposure device as a light source, a developer container storing developer and attached to a main body of the image forming apparatus perpendicular to a lengthwise direction of the photoconductor, a developing unit and a photoconductor unit having a photoconductor for bearing a latent image thereon each detachably attached to the main body substantially in the same direction as the developer container. An exposure device displacing mechanism displaces the exposure device between a first position enabling the exposure device to function as the light source and a second position disabling the exposure device to function as the light source. The photoconductor unit is detached when the developer container is either displaced from an initially attached position or is removed from the main body and the exposure device displacing device has displaced the exposure device to the second position.

18 Claims, 20 Drawing Sheets

(56) References Cited

U.S. PATENT DOCUMENTS

| | | | | |
|---|---|---|---|---|
| 8,311,451 | B2 * | 11/2012 | Nishimura et al. | 399/119 |
| 2006/0140674 | A1 | 6/2006 | Sato | |
| 2008/0007935 | A1 | 1/2008 | Kondo et al. | |
| 2008/0205930 | A1 | 8/2008 | Kawakami et al. | |
| 2008/0219698 | A1 | 9/2008 | Shimizu et al. | |
| 2008/0267661 | A1 | 10/2008 | Yoshida et al. | |
| 2008/0279586 | A1 | 11/2008 | Tatsumi et al. | |
| 2009/0022531 | A1 | 1/2009 | Kubota et al. | |
| 2009/0324263 | A1 | 12/2009 | Shimizu et al. | |
| 2010/0202796 | A1 | 8/2010 | Ooyoshi et al. | |
| 2011/0052255 | A1 | 3/2011 | Yoshida et al. | |
| 2011/0052256 | A1 | 3/2011 | Arasawa | |
| 2011/0103828 | A1 | 5/2011 | Shmizu | |

FOREIGN PATENT DOCUMENTS

| | | | |
|---|---|---|---|
| JP | 05 273846 | A | 10/1993 |
| JP | 09-068848 | A | 3/1997 |
| JP | 2003-255805 | A | 9/2003 |
| JP | 2007-065125 | A | 3/2007 |
| JP | 2008-224821 | A | 9/2008 |
| JP | 2008-224837 | A | 9/2008 |
| JP | 2009-086034 | A | 4/2009 |

OTHER PUBLICATIONS

Chinese Office Action dated Mar. 1, 2013.

* cited by examiner

IMAGE FORMING APPARATUS CAPABLE OF EFFECTIVELY UTILIZING INTERIOR SPACE

CROSS-REFERENCE TO RELATED APPLICATIONS

This patent application is based on and claims priority pursuant to 35 U.S.C. §119 to Japanese Patent Application No. 2010-249758, filed on Nov. 8, 2010, in the Japan Patent Office, Japanese Patent Application No. 2011-156743, filed on Jul. 15, 2011, in the Japan Patent Office, and Japanese Patent Application No. 2011-197186, filed on Sep. 9, 2011, in the Japan Patent Office, and their domestic priority claiming application, the entire disclosure of which is hereby incorporated herein by reference.

FIELD OF THE INVENTION

The present invention relates to an image forming apparatus employing an electrophotographic system, such as a copier, a printer, a facsimile machine, a multifunctional machine combining these devices, etc.

BACKGROUND OF THE INVENTION

In image forming apparatuses employing an electrophotographic system, such as a copier, a printer, a facsimile machine, a multifunctional machine combining these devices, etc., a unit system including a developing unit and a photoconductor unit, such as a process cartridge, etc., is sometimes installed integrally therein. In such an image forming apparatus, the process cartridge needs to be periodically replaced when toner is completely consumed and a toner bottle becomes empty or a photoconductor unit or the like undergoes localized deterioration. Further, the image forming apparatus sometimes employs an LED as an exposure device. In this type of image forming apparatus, the process cartridge is replaced by opening an upper cover provided in an upper section of a main body of the image forming apparatus. The LED is disposed on a path along which the process cartridge would be removed from the image forming apparatus. For this reason, the LED conventionally needs to be displaced from its installed position at the same time or after the upper cover is opened, and the process cartridge is thereafter detached. Alternatively, there exists a system in which an LED serving as an exposure device is detached from a process cartridge by sliding it in its lengthwise direction as disclosed in Japanese Patent Application Publication No. 2003-255805 (JP-2003-255805-A).

Furthermore, it is generally known that when a charging roller used in an electrophotographic image forming apparatus is dirtied by toner and paper dust or the like, image quality suffers. For this reason, a cleaner generally made of foam material, such as foam polyurethane, foam polyester, etc., or a sheet-like member made of felt is conventionally provided to typically engage and clean the charging roller (i.e., a charger). However, when the same cleaner is continuously used for a long time period, cleaning performance thereof deteriorates. Then, a charging roller cleaner is attached to a process cartridge including a photoconductor while the charging roller is attached to a main body of the image forming apparatus, so that the charging roller cleaner can be replaced with a fresh charging roller cleaner every time the process cartridge is replaced, as described in Japanese Patent Application Publication No. H3-126961 (JP-H3-126961-A).

Furthermore, a system in which an LED is displaced and a process cartridge is then extracted from a main body needs a prescribed amount of space along the path along which the process cartridge is extracted, and this prescribed amount of space is not effectively utilized, raising a problem. Further, since the LED is exposed to an outside of the main body every time the process cartridge is replaced, the LED is possibly dirtied or damaged.

Yet further, in a system in which an LED is detachably attached to a process cartridge by sliding the LED in its lengthwise direction as described in JP-2003-255805-A, a side cover attached to the main body needs to be opened to move the LED in its lengthwise direction and detach thereof, or a prescribed amount of interior space is needed for the sliding movement of the LED in its lengthwise direction in the main body. However, when attaching and detaching the LED from the side surface of the main body, a user needs to operate both upper and side surfaces thereof, thereby increasing a working space required for the replacement of the LED, degrading operability. Further, when the space for moving the LED is provided inside the main body, the interior space is not effectively utilized, resulting in effect in upsizing of the main body. Yet further, since the user attaches and detaches the LED taking a certain time period in replacing a process cartridge, the risk of damaging the surface of the LED remains.

Further, in a system in which a charging roller cleaner is provided in a process cartridge as disclosed in JP-H3-126961-A, since the charging roller cleaner is simultaneously replaced with a photoconductor unit, a cycle of replacing the charging roller cleaner becomes longer in proportion to a demand for long life of a photoconductor, thereby degrading its cleaning ability. To solve such a problem, it is possible to attach the charging roller cleaner to either a toner cartridge or a developing unit, which is more frequently replaced, to be replaced independently of the photoconductor unit. However, in a conventional process cartridge or exposure device, a cleaner, a toner cartridge, and a developing unit intercept a light exposing path for guiding exposure light from the exposure device to the photoconductor. Consequently, it is practically impossible for the charging roller cleaner to be attached to either the toner cartridge or the developing unit.

Further, it is known that a problem occurs in an image forming apparatus that employs an electrophotographic system when a charge roller (i.e., a charge member) is dirtied by toner or paper dust or the lie. Accordingly, a cleaner is conventionally employed to clean the charge roller. The cleaner may be made of foam material, such as foam polyurethane, foam polyester, etc., or a sheet like member, such as Felt, etc. The cleaner generally engages the charge roller. However, when the same cleaner is used for a long time, ability of cleaning deteriorates. Then, a system in which a charge roller is attached to an image forming apparatus body while a charge roller cleaner is attached to a process cartridge including a photoconductive member, so that the charge roller cleaner can be replaced every time the process cartridge is replaced as described in Japanese Patent Application Publication No. H3-126961 (JP-H3-126961-A).

Further, in such a system of JP-H3-126961-A, when a photoconductive member unit is to be replaced, a developer container (i.e., a toner bottle) needs to be detached from an apparatus body beforehand. For this reason, a process cartridge and a toner cartridge are sometimes independently detachably attached to a body of the image forming apparatus from each other as disclosed in Japanese Patent Application Publication No. 2001-222160 (JP-2001-222160-A). Specifically, a front cover closing a front surface is provided in a body of the image forming apparatus and is opened to enable drawing of the process cartridge and toner cartridge at a front side. However, the system of JP-2001-222160-A needs to open the front cover. Consequently, a prescribed space is needed around the apparatus body for opening and closing the front cover. Accordingly, a foot print of the apparatus body increases.

To solve such a problem, the apparatus can be moved from a narrow space into a large space readily enabling opening and closing operations for every replacement of the process cartridge and/or toner cartridge. However, such movement degrades usability. In image forming apparatuses employing an electrophotographic system, such as a copier, a printer, a facsimile machine, a multifunctional machine combining these devices, etc., a unit system including a developing unit and a photoconductor unit, such as a process cartridge, etc., is sometimes installed integrally therein. In such an image forming apparatus, the process cartridge needs to be periodically replaced when toner is completely consumed and a toner bottle becomes empty or a photoconductor unit or the like undergoes localized deterioration. Further, the image forming apparatus sometimes employs an LED as an exposure device. In this type of image forming apparatus, the process cartridge is replaced by opening an upper cover provided in an upper section of a main body of the image forming apparatus. The LED is disposed on a path along which the process cartridge would be removed from the image forming apparatus. For this reason, the LED conventionally needs to be displaced from its installed position at the same time or after the upper cover is opened, and the process cartridge is thereafter detached. Alternatively, there exists a system in which an LED serving as an exposure device is detached from a process cartridge by sliding it in its lengthwise direction as disclosed in Japanese Patent Application Publication No. 2003-255805 (JP-2003-255805-A).

SUMMARY OF THE INVENTION

Accordingly, the present invention provides a novel image forming apparatus that includes multiple exposure devices serving as light sources each to form a latent image on a photoconductor. Multiple developer containers are provided to store developer of different component colors and are detachably attached to a main body of the image forming apparatus perpendicular to a lengthwise direction of the photoconductor. Multiple photoconductor units each have at least a photoconductor to bear a latent image thereon. The photoconductor units are detachably attached to the main body substantially in the same direction as the multiple developer containers. Multiple developing units are detachably attached to the main body substantially in the same direction as the developer containers. An exposure device displacing mechanism is provided to displace the exposure devices between a first position enabling the exposure devices to function as the light sources and a second position disabling the exposure devices to function as the light sources. The multiple photoconductor units are detached when the developer containers are either displaced from initially attached positions or are removed from the main body and the exposure device displacing device has displaced the exposure devices to the second position.

In another aspect, one of the developer container and the developing unit is installed on a portion of on a path along which the exposure device during its displacement.

In yet another aspect, the photoconductor unit and the developing unit are integrated being separable from each other.

In yet another aspect, the developer container and the developing unit are integrated.

In yet another aspect, the exposure device displacing mechanism includes a swinging unit to support and displace the exposure devices between the first and second positions.

In yet another aspect, multiple exposure devices are independently displaced from each other between the first and second positions.

In yet another aspect, a photoconductor unit has a photoconductor to bear a latent image thereon and a charger to charge the photoconductor. Only the developer container or a combination of the developer container and the developing unit constitutes a detachably attachable unit detachably attached to the main body in dependent from the photoconductor unit. The detachably attachable unit is installed in the main body on the opposite side of the exposure device in a light emission direction of a light emitted from the exposure device to the photoconductor by the angle of about 180 degree. The detachably attachable unit includes a cleaner to clean a charger for charging the photoconductor when attached.

In yet another aspect, the exposure device is installed in a prescribed position of the main body to enable detachable attachment of the detachably attachable unit without displacing the exposure device from a functioning position.

In yet another aspect, a biasing device is provided to make the cleaner contact or press against the charger when the detachably attachable unit is installed in the prescribed position of the main body.

In yet another aspect, a shielding unit is provided to shield the cleaner and the exposure device from each other. The shielding unit is positioned between the cleaner and the exposure device when the detachably attachable unit is installed in the prescribed position of the main body.

In yet another aspect, a holder is provided to hold the developer containers. A displacement mechanism is provided to displace the holder between a first position in which the at least one developer container is installed in the image forming apparatus body and a second position in which it can be detached therefrom. The developer containers are separated from the photoconductor unit and allow the photoconductor unit to be detached and attached from and to the image forming apparatus body when the holder is in the second position.

In yet another aspect, the second position is created by exposing the developer containers to an outside upwardly from the first position.

In yet another aspect, the displacement mechanism includes a pivotal shaft to swingably support the holder.

In yet another aspect, a body upper cover is provided to close an upper opening of the image forming apparatus. The body upper cover includes a double layer structure composed of outer and inner covers. The inner cover is composed of the holder.

In yet another aspect, the inner cover is openable and closable when the outer cover is opened.

In yet another aspect, the holder holds all of at least two developer containers.

In yet another aspect, the developer containers are separately replaced from each other.

In yet another aspect, the developer containers are separately replaced at random.

BRIEF DESCRIPTION OF THE DRAWINGS

A complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
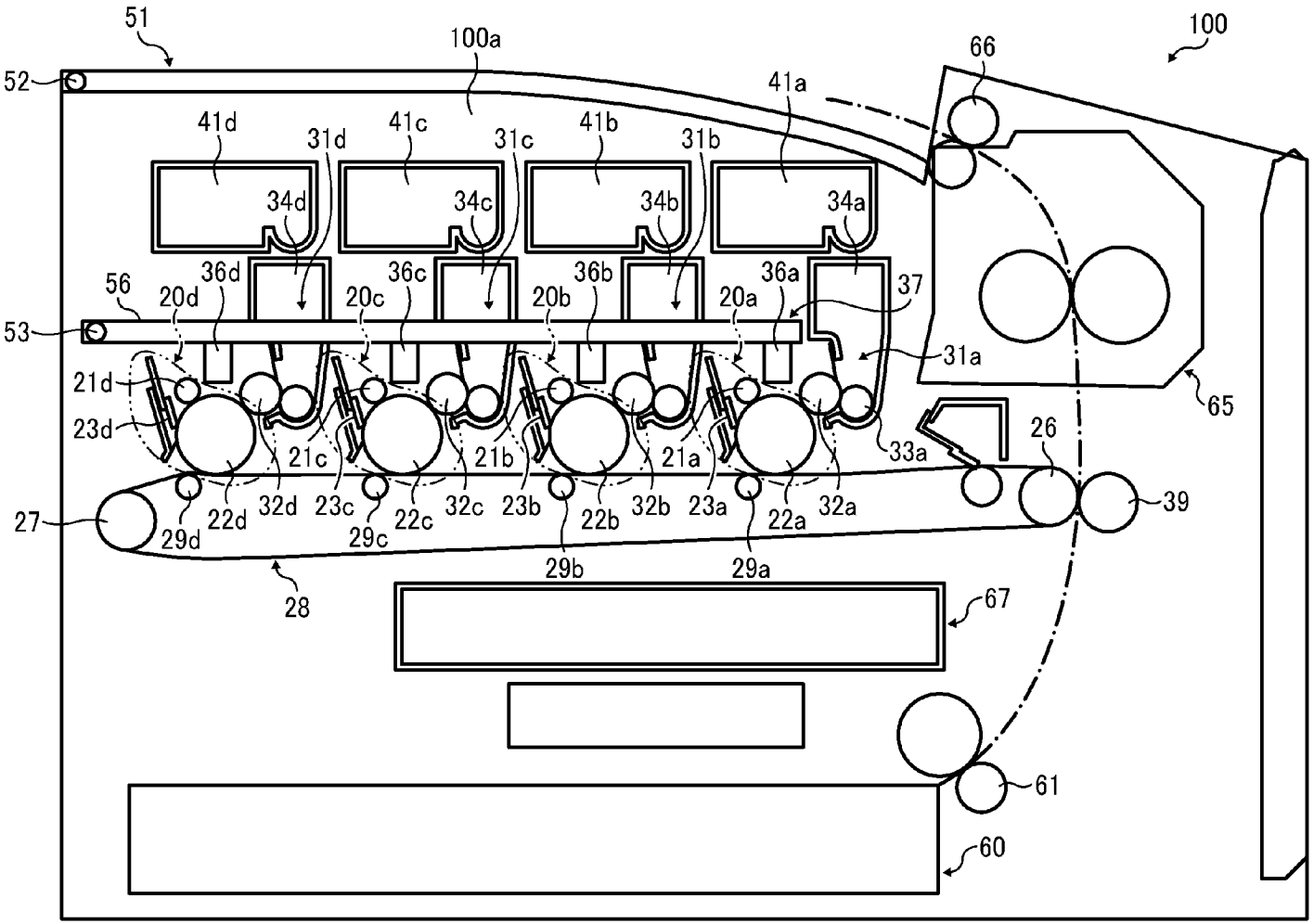
FIG. 1 illustrates the entire configuration of an image forming apparatus according to a first embodiment of the present invention.

Referring now to the drawings, wherein like reference numerals designate identical or corresponding parts throughout the several views thereof, and in particular to FIG. 1, an outline of a color image forming apparatus according to a first embodiment is described.

As shown, on a machine frame 100 (i.e., a main body of the color image forming apparatus), four developer containers (e.g. toner cartridges) 41*a*, 41*b*, 41*c*, and 41*d* storing developer of different component colors, developing units 31*a*, 31*b*, 31*c*, and 31*d*, and photoconductor units 20*a*, 20*b*, 20*c*, and 20*d* or the like are mounted.

The photoconductor units 20*a*, 20*b*, 20*c*, and 20*d* integrally include photoconductors 22*a*, 22*b*, 22*c*, and 22*d*, cleaning blades 23*a*, 23*b*, 23*c*, and 23*d* arranged around the photoconductors 22 to scrape residual toner remaining on the photoconductors 22*a*, 22*b*, 22*c*, and 22*d* after a primary transfer process, and charging rollers 21*a*, 21*b*, 21*c*, and 21*d* engaging the photoconductors 22*a*, 22*b*, 22*c*, and 22*d*, respectively.

Figure 4:
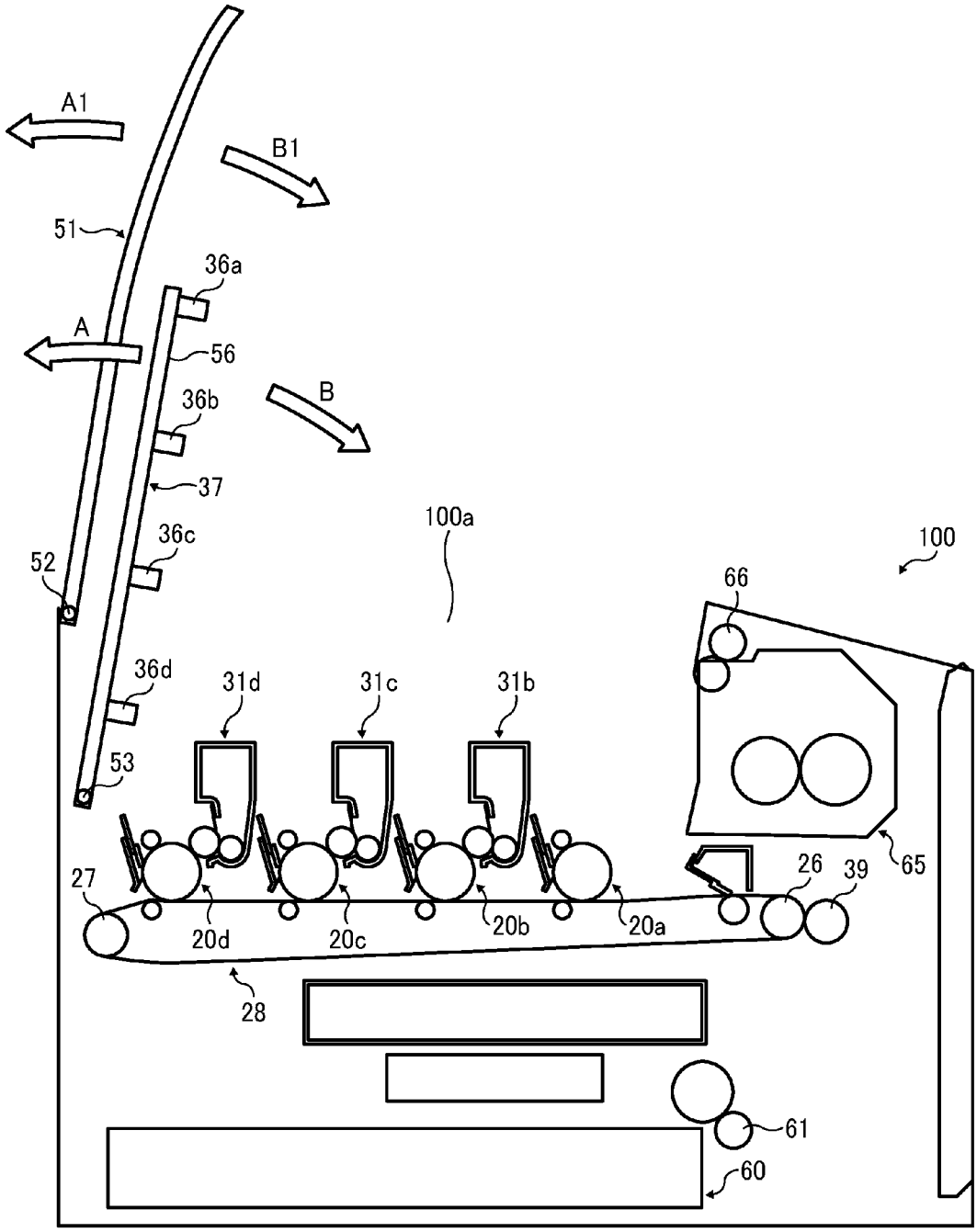
FIG. 4 schematically illustrates an aspect of the image forming apparatus of FIG. 1 when a exposure device deviates from a prescribed position.

Multiple light exposure devices that expose the photoconductors 22*a*, 22*b*, 22*c*, and 22*d* include LEDs (Light Emission Diodes) 36*a*, 36*b*, 36*c*, and 36*d*, respectively. Each of the multiple LEDs 36 takes a first position to function as a light source as shown in FIG. 1 and a second position distanced therefrom as shown in FIG. 4 under operation control of an exposure device displacing mechanism 37.

Such an LED is constituted by an optical writing head that includes a light emission element and a rod lens or the like. Such a light emission element is compact and is capable of saving power while living long.

Specifically, the light exposure device displacing mechanism 37 includes a swing unit 56 (having the same width as the LED in a main scanning direction) connected to a main body of the image forming apparatus 100 via a pivotal shaft 55. The LEDs 36*a*, 36*b*, 36*c*, and 36*d* are arranged on the swing unit 56 at a prescribed pitch (in the subscanning direction). The swinging unit 56 swings in a direction shown by an arrow A from a horizontal state as shown in FIG. 1, to substantially a vertical state as shown in FIG. 4. The swinging unit 56 further swings in the direction shown by an arrow B from substantially the vertical state to substantially the horizontal state. When the swinging unit 56 is in substantially the horizontal state, the LEDs 36*a*, 36*b*, 36*c*, and 36*d* function as a light source as described above, and when it is substantially the vertical state, the LED is displaced from the functioning position. Although it is omitted from the drawings, stoppers may be preferably provided at respective functioning and not functioning positions to limit swinging thereof. Further, such swinging movement of the swinging unit 56 is designed not to interfere with a developing unit 31 and a photoconductor unit 30 or the like.

Further, an intermediate transfer unit is provided including an intermediate transfer belt 28 that engages and disengages the photoconductor 22, and is stretched around driving and driven rollers 26 and 27 as well as multiple primary transfer rollers 29*a*, 29*b*, 29*c*, and 29*d* to circulate therearound.

The developing unit 31 includes a developing roller 32, a supplying roller 33, and a housing 34 or the like. A negative bias voltage is applied to a metal core of the developing roller 32 from a bias power supply, not shown. Further, a negative direct current bias voltage is applied to the charging roller 21 of the photoconductor unit 20 from another bias power supply, not shown.

For this reason, the photoconductor 22 associated with the developing unit 31, the cleaning blade 23 engaging the photoconductor 22, and the charging roller 21 collectively constitute an image formation unit (i.e., a photoconductor unit). Accordingly, 20*a*, 20*b*, 20*c*, and 20*d* can be called first to fourth image formation units, respectively, so that the image forming apparatus includes these four image formation units.

In the first image formation unit 20*a*, a cleaning blade 23*a* cleans stain of residual toner remaining on a circumferential surface of a photoconductor 22*a*. A charging roller 21*a* initializes by uniformly providing electric charge to the circumferential surface of the photoconductor 22*a* at a prescribed high voltage after the above-described cleaning process. Subsequently, the LED 36*a* selectively exposes a surface of the photoconductor 22*a* in accordance with image data. Accordingly, a latent image having a low potential section generated due to attenuation of a voltage caused by the light exposure and a high potential section caused by the above-described initialization is formed on the circumferential surface of the photoconductor 22*a* uniformly bearing the charge at the high level.

The developing unit 31*a* forms a toner image (i.e., execute development) by adhering toner to either the low or high potential section of the latent image. The photoconductor 22*a* is then rotated and conveys the toner image and transfer it onto the intermediate transfer belt 28. By synchronizing with the toner image on the intermediate transfer belt 28 coming to a contact section between the photoconductor 22*b* and the same, the second image formation unit similarly operates as described above, and the developing unit 31*b* makes the latent image on the photoconductor 22*b* to be a toner image. Consequently, the photoconductor 22*b* is rotated and conveys the toner image and superposes it on a previous toner image on the intermediate transfer belt 28. The similar operations are repeated up to the fourth image formation in the fourth image formation unit. Specifically, a multiple color image is formed as a result of superposing of the multiple monochrome toner images on the intermediate transfer belt 28.

A printing medium, not shown, such as a paper sheet, an OHP (Over Head Projector) sheet or the like is supplied from a sheet feeding tray 60 to a secondary transfer device (e.g., a secondary transfer roller) via a pair of conveyance rollers 61 or the like by synchronizing with the multiple color image carried on the intermediate transfer belt 28. When a monochrome or multi color image borne on the transfer belt 28 is transferred on to the recording medium, a potential difference is generated between the transfer belt 28 and the secondary transfer device 39 by applying a high voltage to the secondary transfer device 39. Hence, the toner image on the surface of the transfer belt 28 is preferably transferred onto the recording medium.

The recording medium with the transferred toner image is separated from the transfer belt 28. Subsequently, the fixing device 65 fuses and fixes the toner image onto the recording medium. The sheet ejection device 66 then ejects the recording medium onto a sheet ejection tray provided on an upper surface of the main body 100 of the image forming apparatus.

Residual toner remaining on the transfer belt 28 after such toner image transfer onto the recording medium is cleaned by an intermediate transfer unit cleaner and is collected by a toner collector 67. The thus cleaned transfer belt 28 becomes prepared for the next toner image transfer process.

Figure 2:
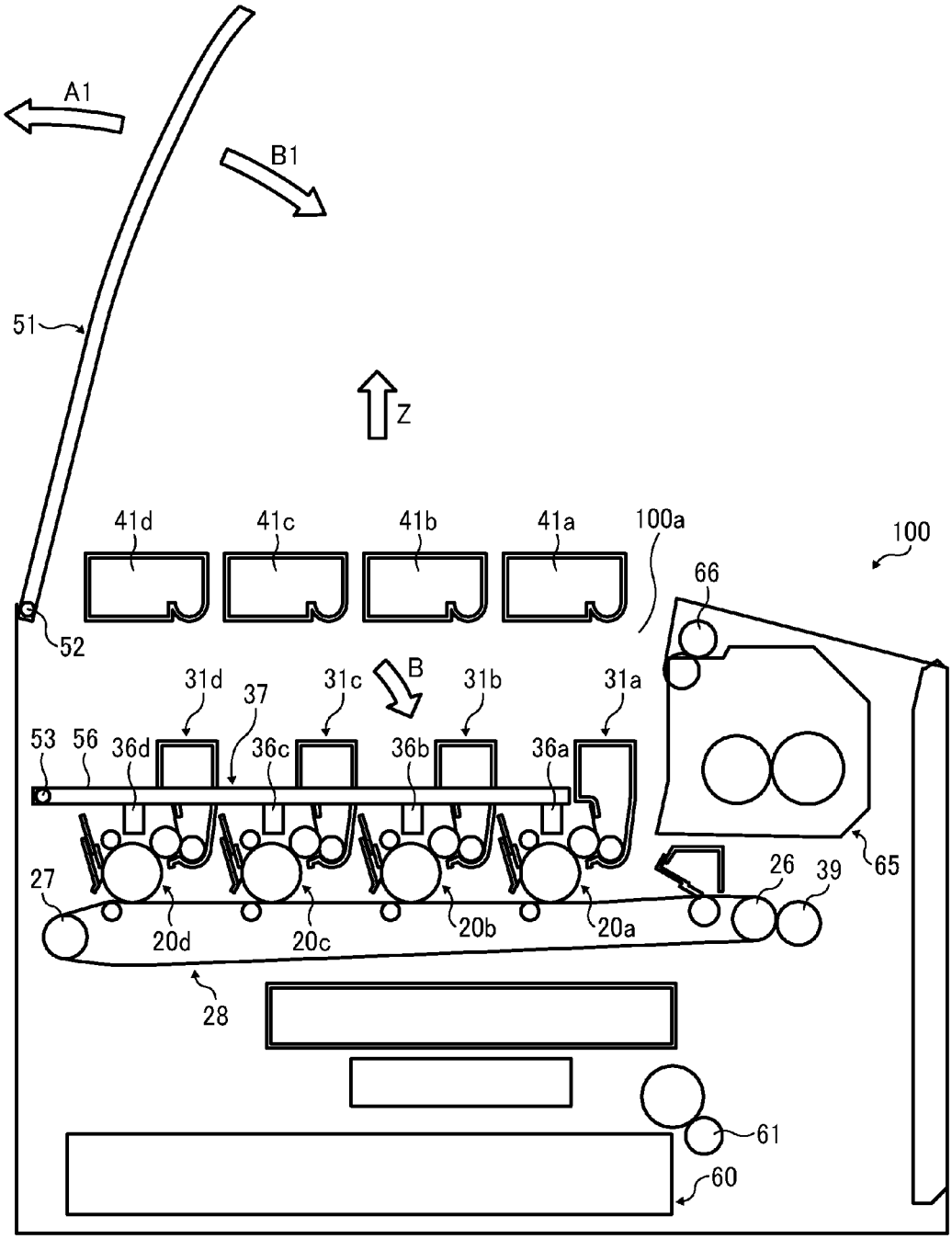
FIG. 2 schematically illustrates an aspect of the image forming apparatus of FIG. 1 when a developer container is being detached therefrom.

Further, a main body upper cover 51 is provided in an upper part of the apparatus main body 100. Specifically, the main body upper cover 51 is attached to the apparatus main body 100 via another pivotal shaft 52 provided above the pivotal shaft 53 of the swinging unit 56. Accordingly, the main body upper cover 51 takes two positions to close and open an opening 100*a* formed on the top of the apparatus main body 100 as shown in FIGS. 1 and 2, respectively. Specifically, the opening 100*a* of the apparatus main body 100 enters from the closing condition to the opening condition as shown in FIG. 2 or the like when the main body upper cover 51 is swung in the direction shown by an arrow A1 around the pivotal shaft 52. By contrast, the opening 100*a* of the apparatus main body 100 enters from the opening condition to the closing condition as shown in FIG. 1 or the like when the main body upper cover 51 is swung in the direction shown by an arrow B1 around the pivotal shaft 52.

Now, a manner of replacing a photoconductor unit 20 included in the image forming apparatus having the above-described configuration is described more in detail. Initially, a manner of detaching a photoconductor unit 20 from the image forming apparatus, in which each of the units is installed as shown in FIG. 1, is described.

By swinging the main body upper cover 51 in the direction shown by an arrow A1 from the condition thereof as shown in FIG. 1, the opening 100*a* of the apparatus main body 100 is opened. In this condition, the respective developer containers (i.e., process cartridges) 41*a*, 41*b*, 41*c*, and 41*d* are then drawn in a direction shown by an arrow Z (i.e., a direction perpendicular to a lengthwise direction of the photoconductor 22, herein after substantially the same) from the apparatus main body 100 via the opening 100*a*.

Subsequently, the developing units 31*a* to 30*d* are detached in the direction shown by arrow Z from the apparatus main body 100 via the opening 100*a* as partially shown in FIG. 3. However, all of the developing units 31 is not necessarily detached, and only necessary prescribed one or more developing units may be done so as typically shown in FIG. 3. Specifically, only the developing unit 31*a* may be detached.

Subsequently, as shown in FIG. 4, the light exposure device displacing mechanism 37 deviates the LEDs 36 by swinging the swinging unit 56 in the direction shown by arrow A. Consequently, the photoconductor unit 20*a* is typically ready for detaching, and is detached from the apparatus main body 100 via the opening 100*a* in the direction shown by the arrow Z in FIG. 5.

Figure 5:
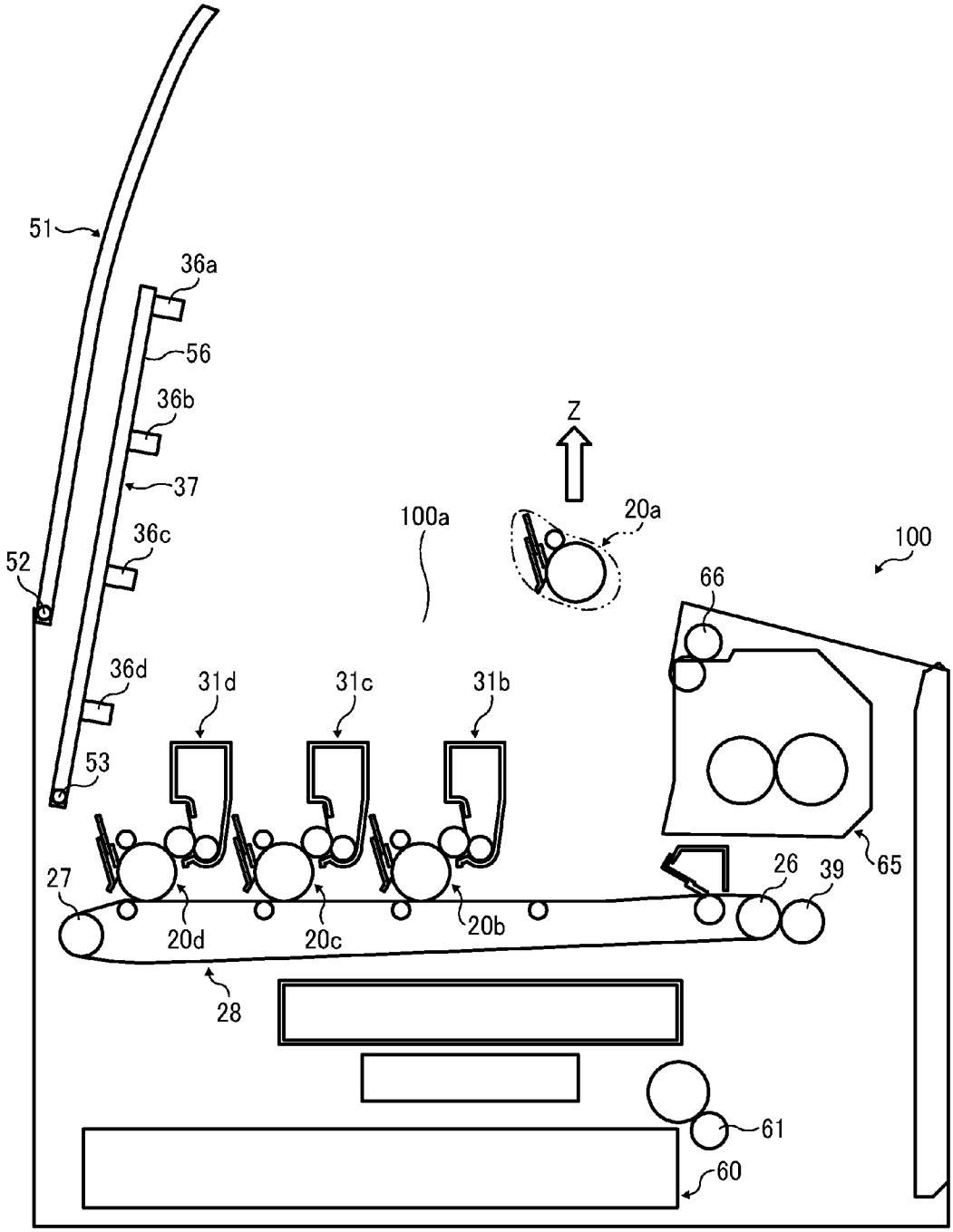
FIG. 5 schematically illustrates an aspect of the image forming apparatus of FIG. 1 when a photoconductor unit is being detached.

Now, a manner of typically installing the photoconductor unit 20*a* is described by contrast. In this situation, the above-described detaching manner is simply oppositely executed to practice this manner. Thus, as shown in FIGS. 4 and 5, the main body upper cover 51 is swung in the direction shown by the arrow A1, and the opening 100*a* of the apparatus main body 100 is opened. Subsequently, the swinging unit 56 of the light exposure device displacing mechanism 37 is swung in the direction shown by the arrow A to deviate the LEDs 36*a*, 36*b*, 36*c*, and 36*d*. In this condition, the photoconductor unit 20*a* is subsequently installed in the opposite direction to that as shown by the arrow Z.

Subsequently, the light exposure device displacing mechanism 37 makes the swinging unit 56 swing in the direction shown by the arrow B in FIG. 3 to bring the LEDs 36 into a functioning condition. Subsequently, the developing unit 31*a* is typically installed in the direction opposite the direction shown by the arrow Z. The developer containers (i.e., toner cartridges) 41*a* to 41*d* are installed in the opposite direction to that shown by the arrow Z. Subsequently, the main body upper cover 51 is swung in the direction shown by an arrow B1 and covers the opening 100*a* of the apparatus main body 100, thereby completing installation of the photoconductor unit 20*a* therein.

According to the above-described first embodiment of the present invention, since the developer containers 41*a*, 41*b*, 41*c*, and 41*d* can be detached before the LEDs 36 are displaced from the functioning positions, the developer containers 41*a*, 41*b*, 41*c*, and 41*d* can be arranged on an excursion of the LEDs 36 formed during their deviation therefrom, thereby capable of increasing capacity of each of the developer containers 41*a*, 41*b*, 41*c*, and 41*d*.

Further, toner is generally most frequently replaced among other consumable items used in an electrophotographic image forming apparatus. Accordingly, a developer container is most frequently replaced as far as it is independently replaceable from the other consumable items. However, in a conventional system, LEDs are displaced every when developer containers are replaced, thereby having high risk of damaging the LEDs. By contrast, according to the first embodiment of the present invention, detaching and attaching operations of the photoconductor units 20*a*, 20*b*, 20*c*, and 20*d* can be safe and precise. In addition, the photoconductor units 20*a*, 20*b*, 20*c*, and 20*d* do not intercept the light exposure devices during their detaching and attaching (i.e., installation) operations, thereby capable of suppressing damage on the light exposure devices as well. Further, when the developer containers 41*a*, 41*b*, 41*c*, and 41*d* are replaced, the light exposure devices do not need to deviate, thereby capable of decreasing a chance of exposing the exposure devices to outside of the apparatus main body while reducing risk of having stain and cuts. Further more, when the developer containers 41*a*, 41*b*, 41*c*, and 41*d* and the photoconductor units 20*a*, 20*b*, 20*c*, and 20*d* are replaced, since the light exposure devices do not need to be detached from the apparatus main body 100, risk of erroneously damaging the light exposure devices by an operator can be suppressed.

Further more, in the excursion of the light exposure devices deviating from a prescribed functioning positions, the developer containers 41*a*, 41*b*, 41*c*, and 41*d* and the developing units 31*a*, 31*b*, 31*c*, and 31*d* can entirely or partially be installed, thereby effectively utilizing an inner space for the light exposure device to deviate in the image forming apparatus main body 100. When such an effectively inner space usable system is compared with a system which does not, a height of the apparatus main body can be decreased in the former system than in the latter system storing the prescribed same amount of developer.

The developer containers 41*a*, 41*b*, 41*c*, and 41*d*, the photoconductor units 20*a*, 20*b*, 20*c*, and 20*d*, and the developing units 31*a*, 31*b*, 31*c*, and 31*d* can be detachably attached in the direction perpendicular to a lengthwise direction of the photoconductors, so that replacing operation can be performed in one direction thereby capable of improving replaceability of those devices, in addition, for the same reason, a footprint of the image forming apparatus main body 100 and a floor area needed during replacement can be minimized as well.

Further more, since the swinging unit 56 is provided to support the light exposure devices, a deviating operation deviating the light exposure devices, and detachment and attachment of the photoconductor units 20*a*, 20*b*, 20*c*, and 20*d* can be stabilized at the same time. With the LEDs 36, the light exposure devices can maintain advantages the LED inherently includes, such as power saving, long life, compactness, etc.

Further, in the above-described embodiment, the LEDs 36*a*, 36*b*, 36*c*, and 36*d* need to deviate after the developer containers 41*a*, 41*b*, 41*c*, and 41*d* has been detached as shown in FIG. 2. For this reason, a lock mechanism is preferably provided to only allow the swinging unit 56 having the LEDs 36*a*, 36*b*, 36*c*, and 36*d* to swing to a prescribed direction after the developer containers 41*a*, 41*b*, 41*c*, and 41*d* have been detached. That is, the LEDs 36*a*, 36*b*, 36*c*, and 36*d* and the developer containers 41*a*, 41*b*, 41*c*, and 41*d* possibly engage or contact each other thereby damaging the LEDs 36*a*, 36*b*, 36*c*, and 36*d* when the main body upper cover 51 is swung in the direction shown by the arrow A1 and the opening is opened and the LEDs then deviate even though the developer containers 41*a*, 41*b*, 41*c*, and 41*d* are not detached as shown in FIGS. 2 and 3 or the like.

Now, another example is described with reference to FIG. 6. As shown, a developer container (toner cartridges) 41*a*, 41*b*, 41*c*, and 41*d* are detachably attached to the main body upper cover 51 in an image forming apparatus. Accordingly, the developer containers 41*a*, 41*b*, 41*c*, and 41*d* integrally swing with the main body upper cover 51.

Figure 6:
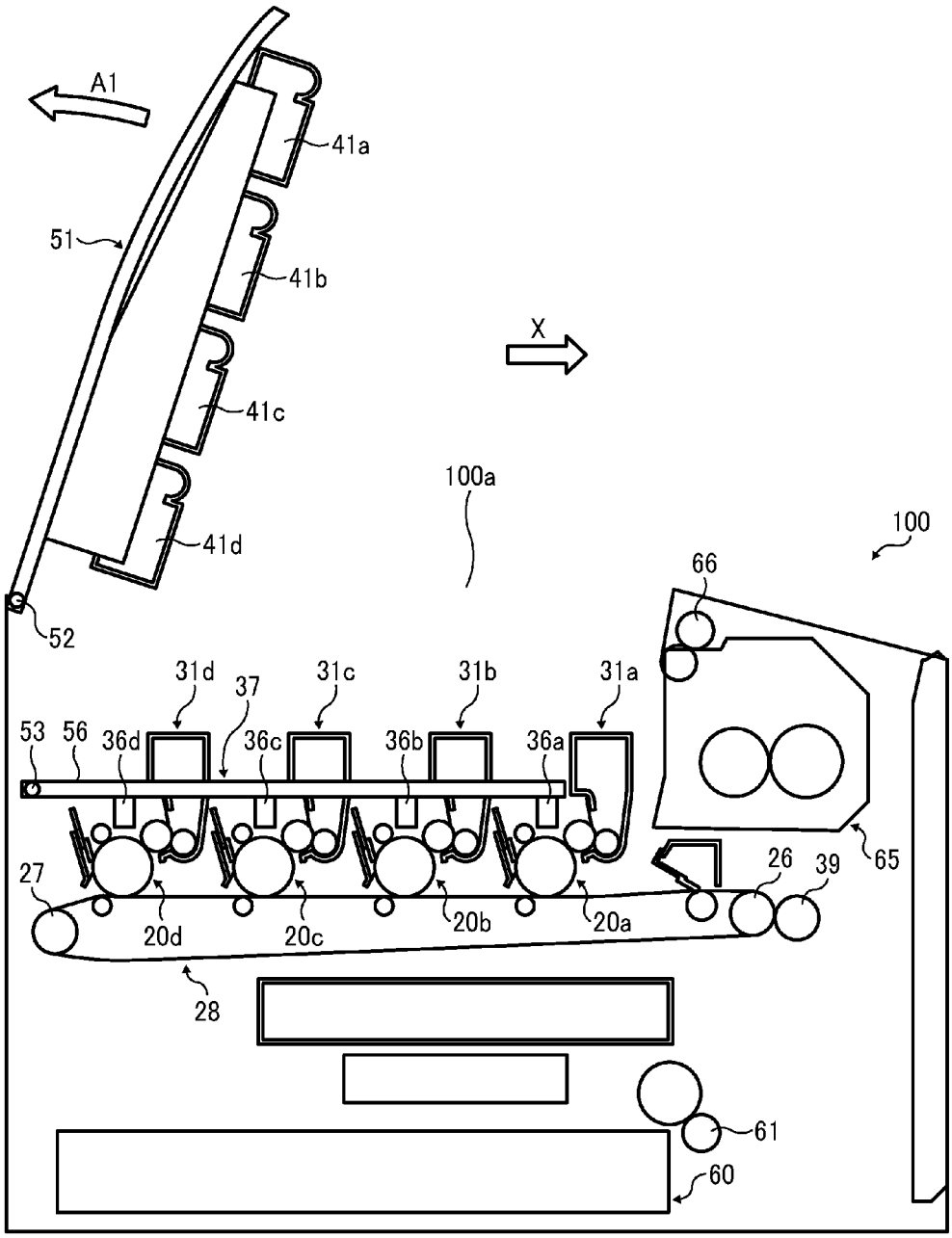
FIG. 6 schematically illustrates an aspect of the image forming apparatus when a developer container departs from its initial attachment position therein according to a second embodiment of the present invention.

Thus, to detach photoconductor units 20*a*, 20*b*, 20*c*, and 20*d* or the like from the image forming apparatus of FIG. 6, the main body upper cover 51 is swung and the opening 100*a* of the apparatus main body 100 is opened thereby displacing and separating the developer containers 41*a*, 41*b*, 41*c*, and 41*d* from initial attachment positions as the main body upper cover 51 swings. Then, each of the developer containers 41*a*, 41*b*, 41*c*, and 41*d* is detached from the main body upper cover 51 in the direction shown by an arrow X.

Figure 3:
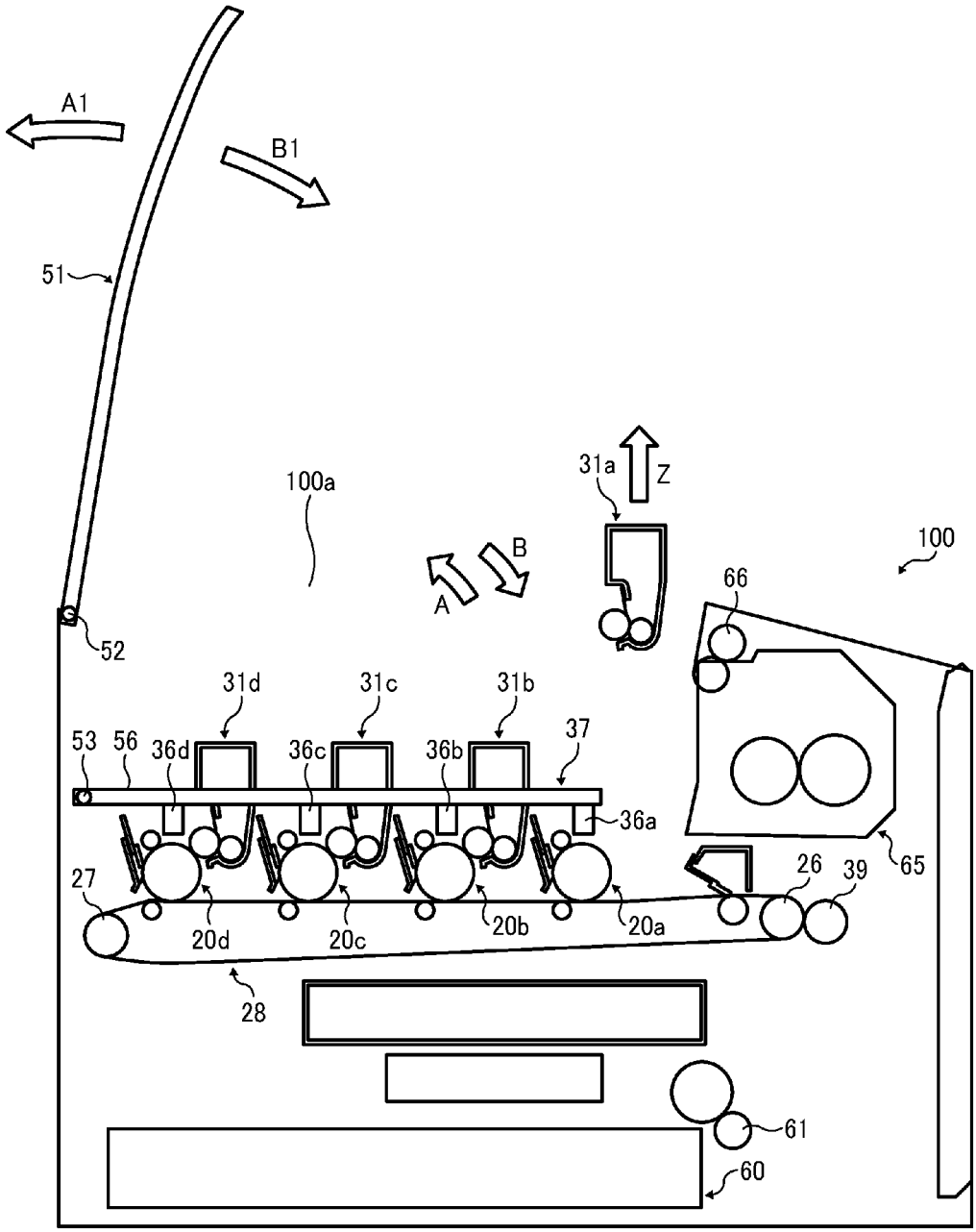
FIG. 3 schematically illustrates an aspect of the image forming apparatus of FIG. 1 when a developing unit is being detached therefrom.

After that, as shown in FIGS. 3 to 5, the developing units 31*a*, 31*b*, 31*c*, and 31*d* are detached therefrom, and the LEDs 36*a*, 36*b*, 36*c*, and 36*d* are then deviated, and the photoconductor units 20*a*, 20*b*, 20*c*, and 20*d* are finally detached from the main body. By contrast, to typically install the photoconductor unit 20*a*, opposite operation is executed to the above-described detaching operation.

Accordingly, the image forming apparatus of FIG. 6 exerts substantially the same function and has substantially the same result as the image forming apparatus of FIG. 1. Further, without detaching the developer containers 41*a*, 41*b*, 41*c*, and 41*d* from the main body upper cover 51, the developing units 31*a*, 31*b*, 31*c*, and 31*d* or the photoconductor units 20*a*, 20*b*, 20*c*, and 20*d* can be advantageously detached or attached to the apparatus main body.

Further, the image forming apparatus of FIG. 6 can execute opening of the main body upper cover 51 and movement of the cartridges 41*a*, 41*b*, 41*c*, and 41*d* at the same time, replacing operation becomes further simpler for an operator. In the image forming apparatus of FIG. 6, since the developer containers 41*a*, 41*b*, 41*c*, and 41*d* moves together with the main body upper cover 51, the developer containers 41*a*, 41*b*, 41*c*, and 41*d* are necessarily detached in the direction shown by the arrow X from a condition as shown in FIG. 6 when it is detached from the image forming apparatus main body 100. However, even in such a situation, as shown in FIG. 6, when they are separated from the initially attached positions, the developer containers 41*a*, 41*b*, 41*c*, and 41*d* necessarily move in the direction shown by the arrow Z (i.e., perpendicular to a lengthwise direction of the photoconductor 22). Thus, it is also true that the developer containers 41*a*, 41*b*, 41*c*, and 41*d* are detachably attachable perpendicular to the lengthwise direction of the photoconductors 22 in FIG. 6.

Now, yet another example of an image forming apparatus is described with reference to FIG. 7. As shown, each of the developer containers 41*a*, 41*b*, 41*c*, and 41*d* is integral with each of the developing units 31*a*, 31*b*, 31*c*, and 31*d* as a unit called a DTM42. Specifically, a housing 34 integrally houses one of the developing units 31*a*, 31*b*, 31*c*, and 31*d* and one of the developer containers 41*a*, 41*b*, 41*c*, and 41*d*.

Figure 7:
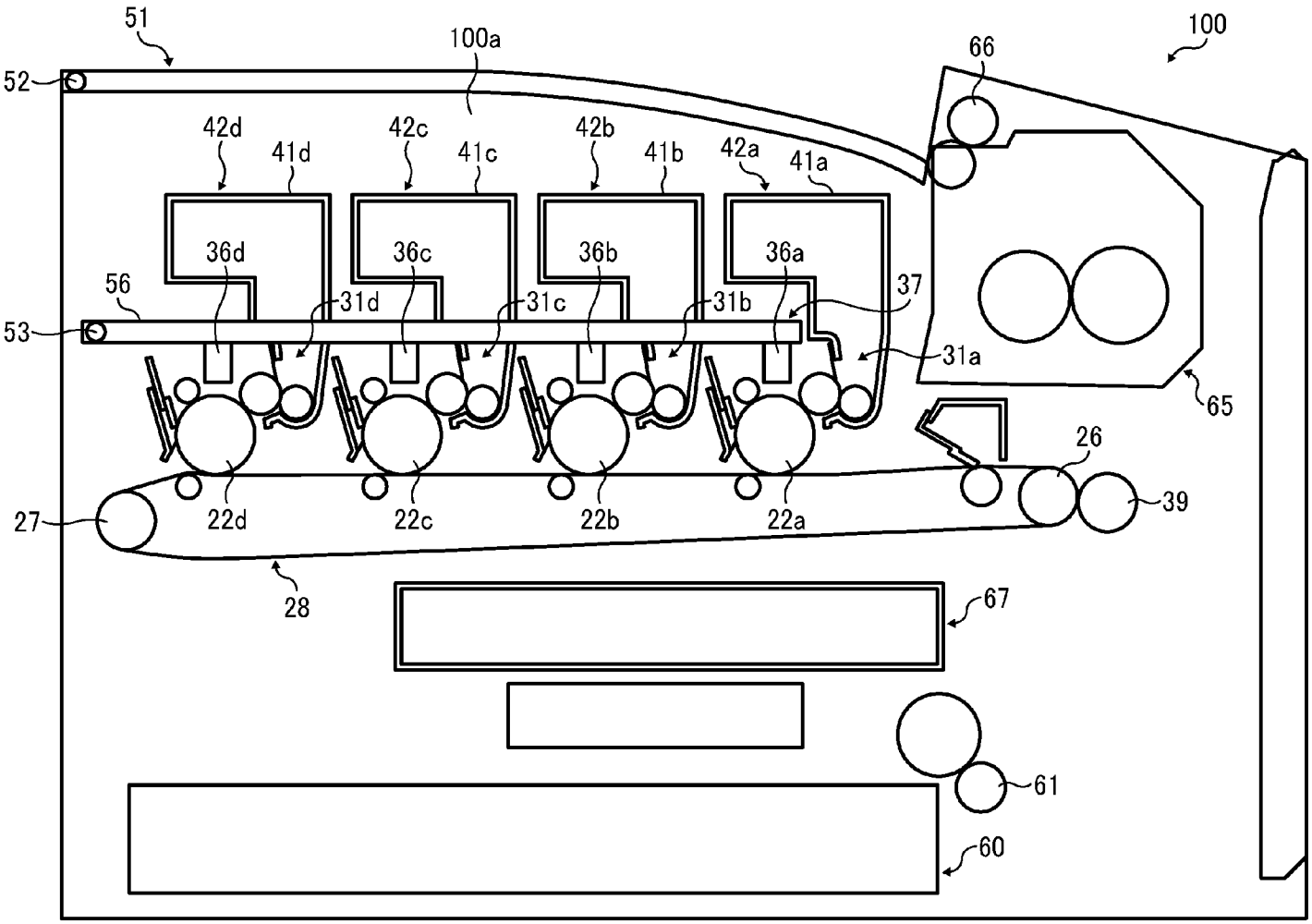
FIG. 7 illustrates the entire configuration of an image forming apparatus according to a third embodiment of the present invention.

Now, a manner of replacing the photoconductor units 20*a*, 20*b*, 20*c*, and 20*d* from the image forming apparatus of FIG. 7 is described with reference to FIG. 8. Initially, a manner of detaching photoconductor units 20*a*, 20*b*, 20*c*, and 20*d* is described with reference to FIG. 8. As shown, the main body upper cover 51 is swung in the direction shown by the arrow A1 and the opening 100*a* of the apparatus main body 100 is opened, the DTMs 42*a*, 42*b*, 42*c*, and 42*d* are detached in the direction shown by the arrow Z.

Subsequently, the light exposure device displacing mechanism 37 swings the swinging unit 56 in the direction shown by the arrow A and deviates the LEDs 36 from prescribed positions. Hence, the photoconductor unit 20*a* is typically ready for detachment, and is practically detached from the apparatus main body 100 in the direction shown by the arrow Z via the opening 100*a*. By contrast, to typically install the photoconductor units 20*a*, the opposite operation to the above-described detaching operation is executed.

Accordingly, the image forming apparatus of FIG. 7 also similarly operates and obtains the similar result as that of FIG. 1 or the like. In addition, since the developer containers 41*a*, 41*b*, 41*c*, and 41*d* and the developing units 31*a*, 31*b*, 31*c*, and 31*d* are integral, respectively, handling performance is good.

Figure 8:
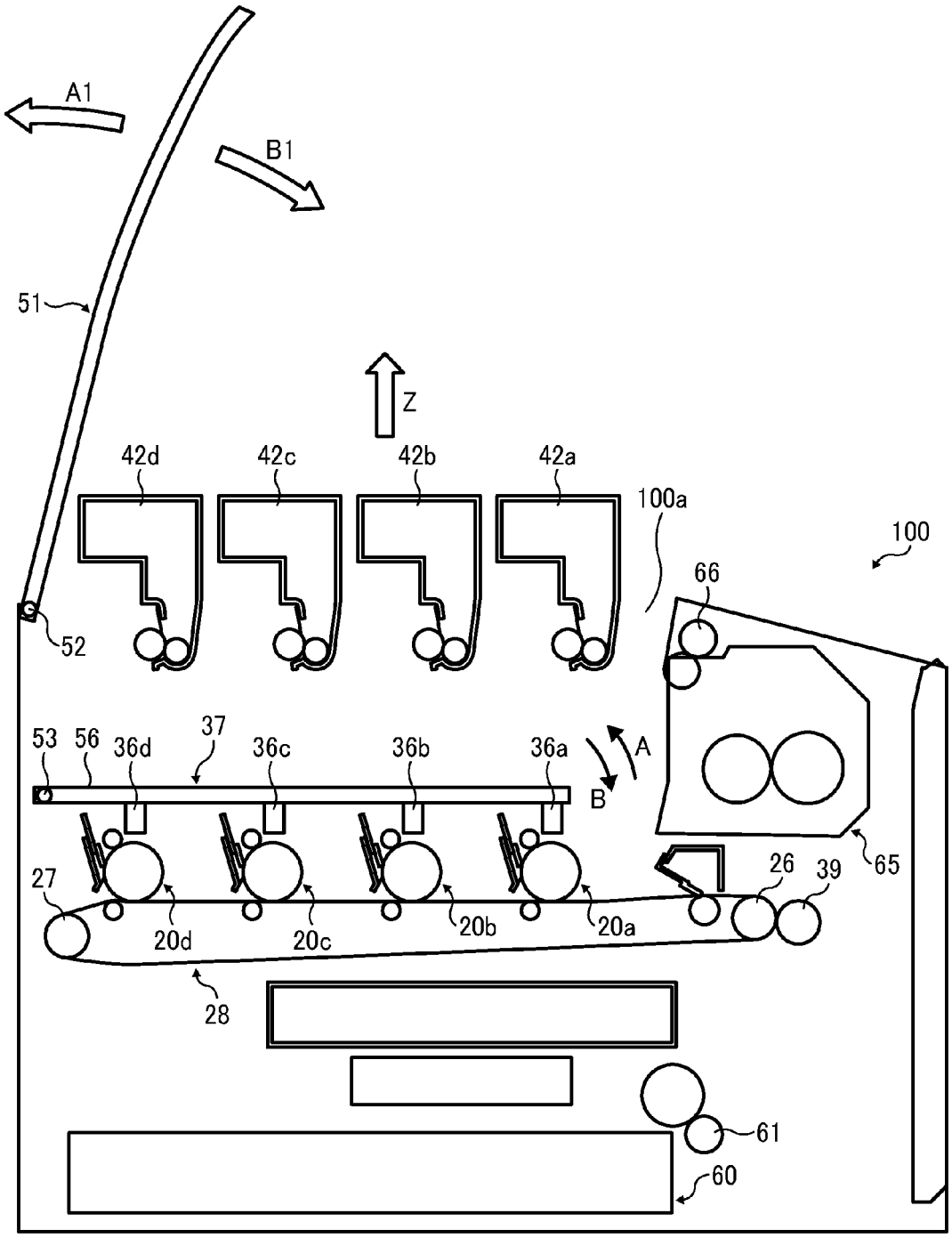
FIG. 8 schematically illustrates an aspect of the image forming apparatus of FIG. 7 when a developer container is being detached therefrom.

Further, the image forming apparatus of FIGS. 7 and 8 also preferably includes the lock mechanism to only allow the swinging unit 56 having the LEDs 36*a*, 36*b*, 36*c*, and 36*d* to swing to a prescribed direction only after the DTMs 42*a*, 42*b*, 42*c*, and 42*d* have been detached.

Now, yet another image forming apparatus is described with reference to FIG. 9. As shown, the developing units 31*a*, 31*b*, 31*c*, and 31*d* and the photoconductor units 20*a*, 20*b*, 20*c*, and 20*d* are respectively integral forming process cartridges 43*a*, 43*b*, 43*c*, and 43*d*. A manner of replacing the process cartridges 43*a*, 43*b*, 43*c*, and 43*d* implemented in the image forming apparatus of FIG. 9 is herein below described.

Figure 10:
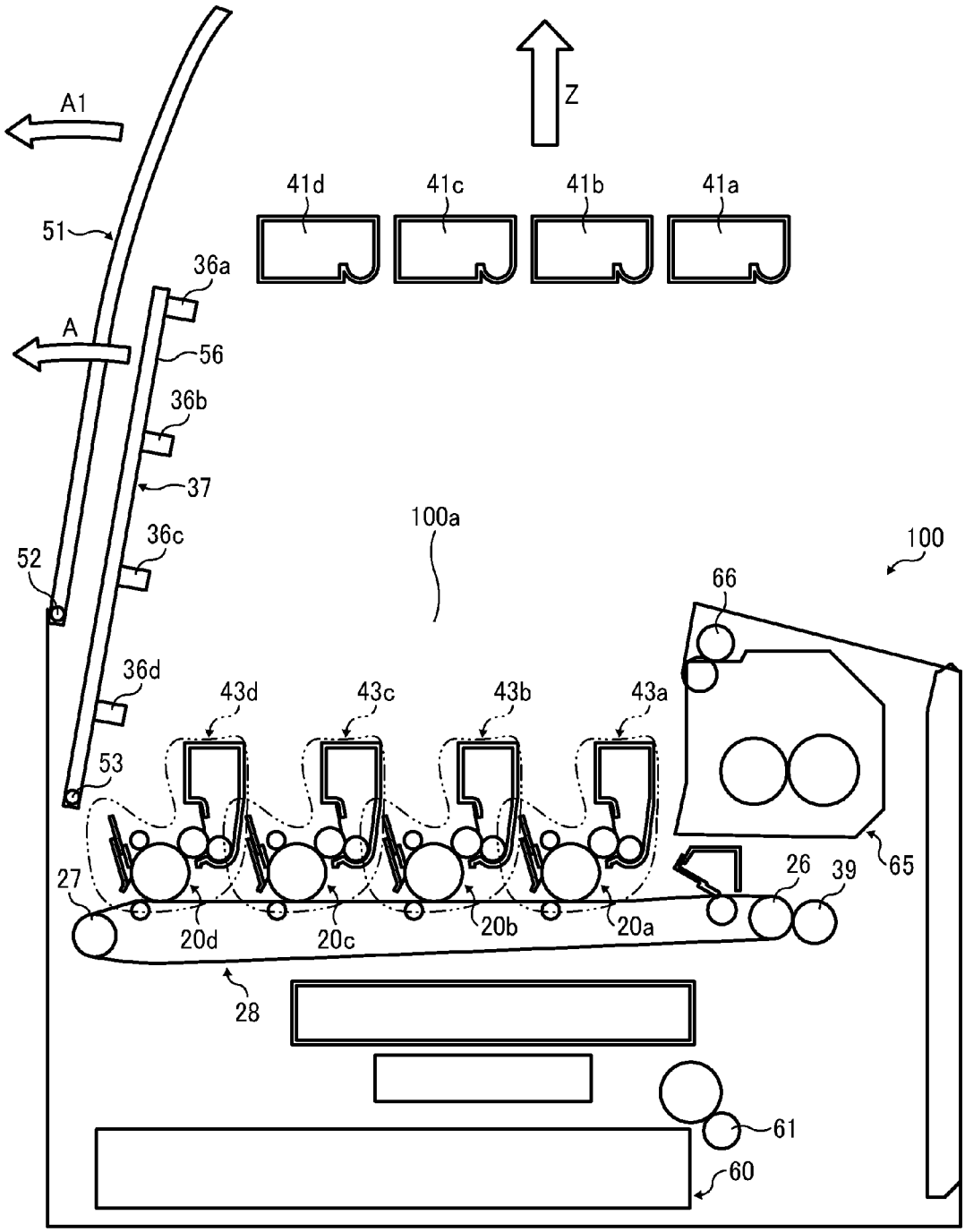
FIG. 10 schematically illustrates an aspect of the image forming apparatus of FIG. 9 when a exposure device deviates from a prescribed position.
Figure 11:
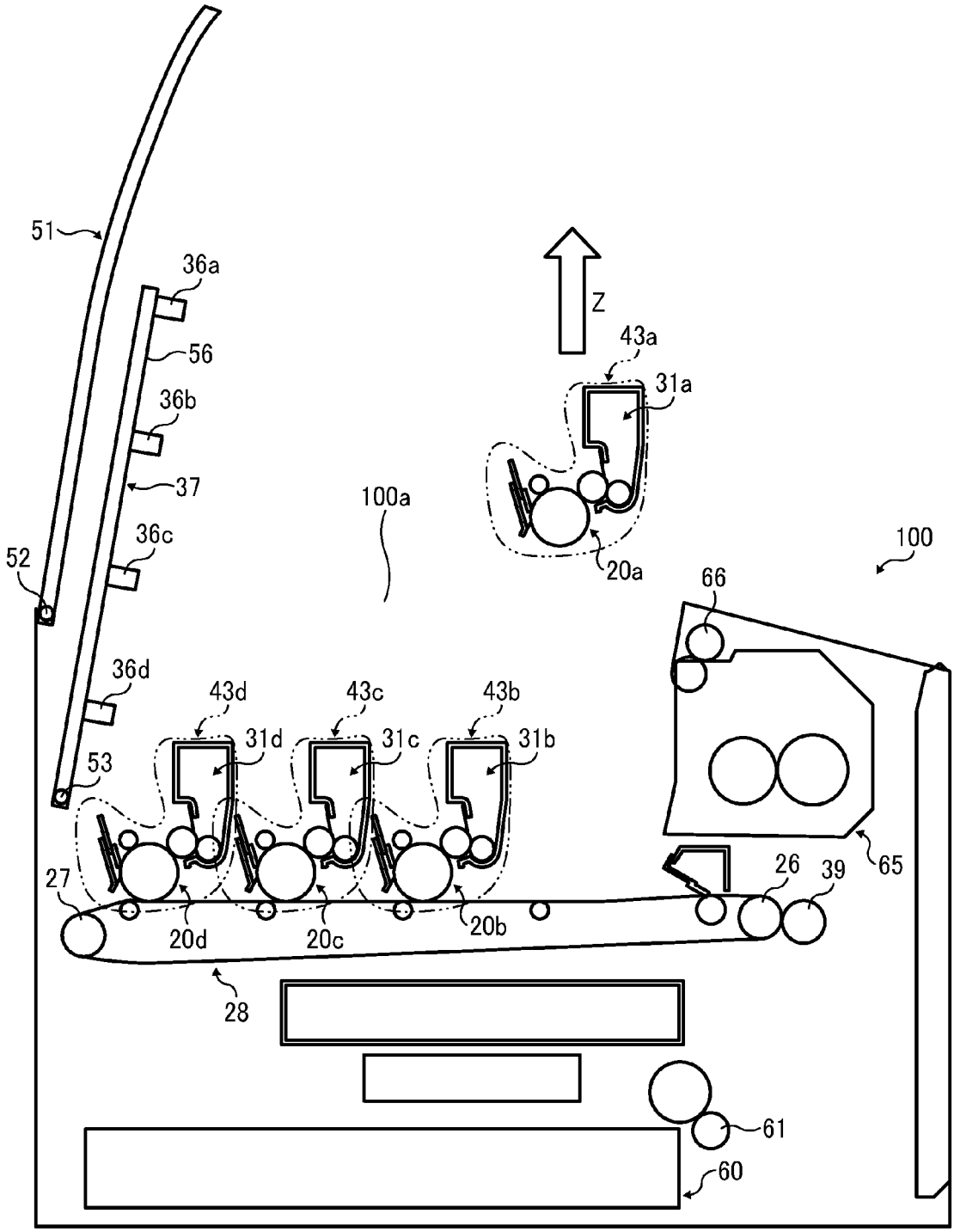
FIG. 11 schematically illustrates an aspect of the image forming apparatus of FIG. 9 when a process cartridge is being detached therefrom.

Also in this image forming apparatus, the main body upper cover 51 is swung in the direction shown by the arrow A and the opening 100*a* of the apparatus main body 100 is opened. Subsequently, the developer containers 41*a*, 41*b*, 41*c*, and 41*d* are detached in the direction shown by the arrow Z as shown in FIG. 10. Then, the swinging unit 56 is swung in the direction shown by the arrow A to displace the LEDs 36*a*, 36*b*, 36*c*, and 36*d*. After that, the process cartridges 43*a*, 43*b*, 43*c*, and 43*d* are accordingly detached as shown in FIG. 11. By contrast, attachment of the process cartridges 43*a*, 43*b*, 43*c*, and 43*d* is executed opposite to the above-described detaching operation.

Accordingly, the image forming apparatus of FIG. 7 also similarly operates and obtains the similar result as that of FIG. 1 or the like. In addition, since the developing units 31*a*, 31*b*, 31*c*, and 31*d* and the photoconductor units 20*a*, 20*b*, 20*c*, and 20*d* are respectively integral, handling performance is good. However, the developing units 31*a*, 31*b*, 31*c*, and 31*d* and the photoconductor units 20*a*, 20*b*, 20*c*, and 20*d* are respectively preferably dividable to improve replacement effectiveness of each unit.

Figure 9:
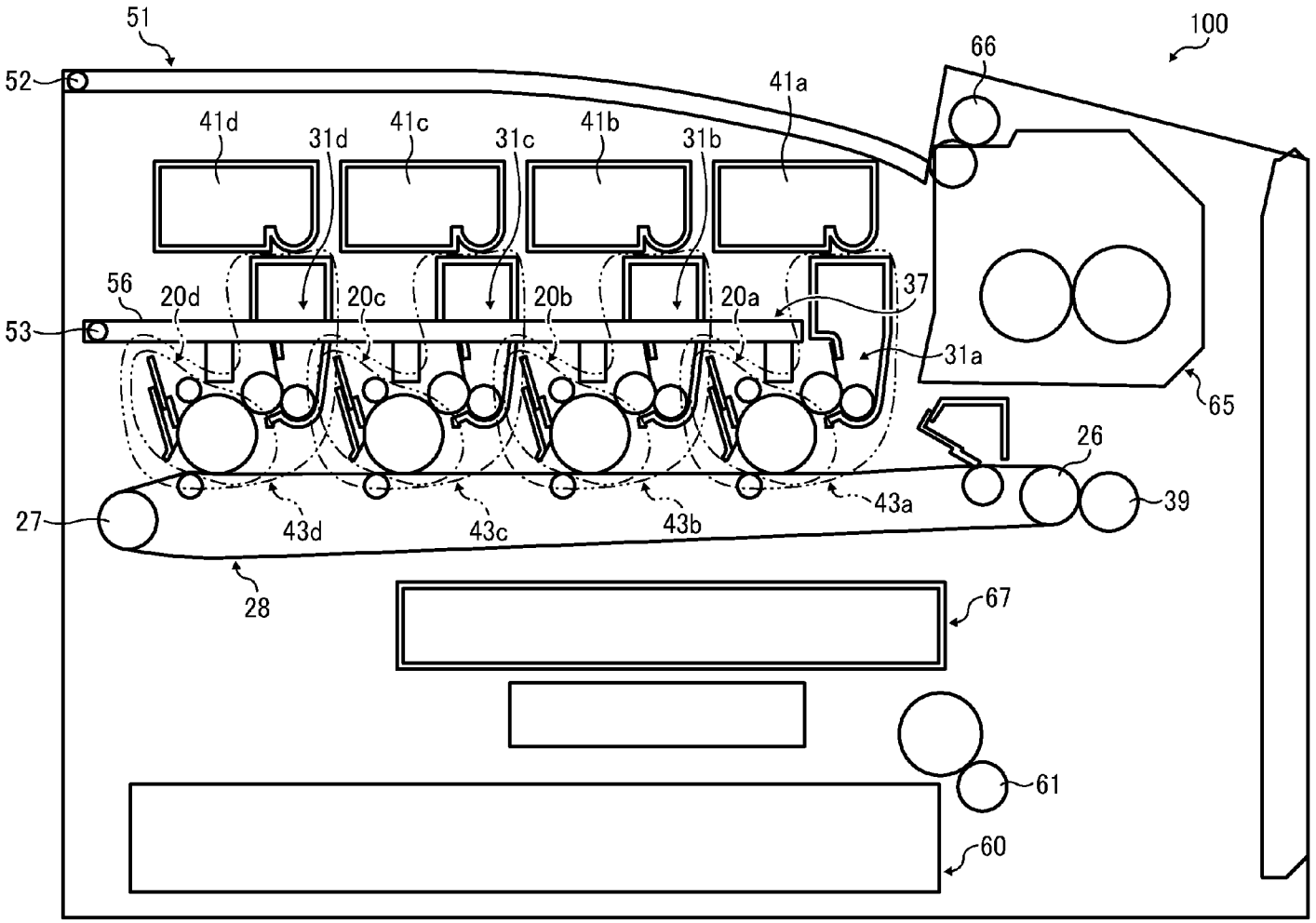
FIG. 9 illustrates the entire configuration of an image forming apparatus according to a fourth embodiment of the present invention.

Further, in the image forming apparatus of FIG. 9, when the process cartridges 43*a*, 43*b*, 43*c*, and 43*d* are detached without displacing the LEDs 36*a*, 36*b*, 36*c*, and 36*d*, those devices possibly contact or engage each other. To solve such a possible problem, a lock mechanism is again preferably included in the image forming apparatus of FIG. 9 only to allow the process cartridges 43*a*, 43*b*, 43*c*, and 43*d* to be detached after the LEDs 36*a*, 36*b*, 36*c*, and 36*d* have deviated.

Now, yet another image forming apparatus is described with reference to FIG. 12. As shown, the photoconductor units 20*a*, 20*b*, 20*c*, and 20*d* are substantially vertically arranged. Hence, the developer containers (i.e., process cartridges) 41*a*, 41*b*, 41*c*, and 41*d*, the developing units 31*a*, 31*b*, 31*c*, and 31*d*, and the intermediate transfer belt 28 or the like are vertically arranged, accordingly.

Further, the image forming apparatus main body 100 includes a side opening 100*b* formed on a side wall and covered by a side wall cover 70. Specifically, the side wall cover 70 swings around a pivotal shaft 71 in a direction shown by arrows C1 ands D1.

The light exposure device displacing mechanism 37 is also provided and is constituted by a swinging unit 73 having a pivotal shaft 72 in the vicinity of the pivotal shaft 71 of the side wall cover 70. Then, as shown in FIG. 12, when the swinging unit 73 is arranged vertically, the LEDs 36*a*, 36*b*, 36*c*, and 36*d* take functioning positions, respectively. By contrast, when the swinging unit 73 is arranged horizontally, the LEDs 36*a*, 36*b*, 36*c*, and 36*d* take deviated positions, respectively. In short, the swinging unit 73 swings both directions shown by arrows C and D around the pivotal shaft 72.

Figure 12:
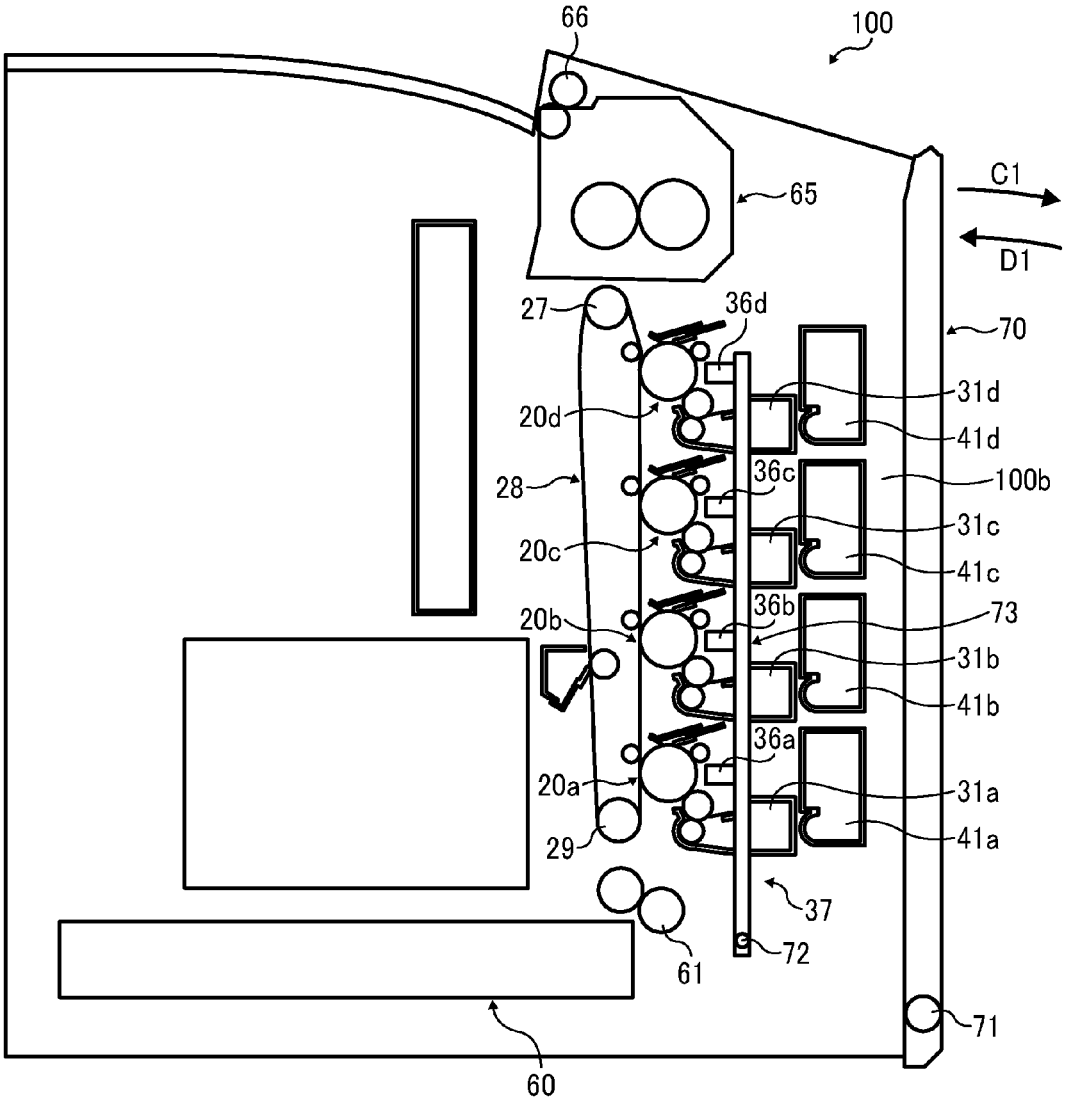
FIG. 12 illustrates the entire configuration of an image forming apparatus according to a fifth embodiment of the present invention.

Now, a manner of replacing the photoconductor units 20*a*, 20*b*, 20*c*, and 20*d* in the image forming apparatus of FIG. 12 is described. Initially, a manner of detaching the photoconductor units 20*a*, 20*b*, 20*c*, and 20*d* is described. The side wall cover 70 is swung in the direction shown by the arrow C1 around the pivotal shaft 71 from a condition shown in FIG. 12 and opens the side opening 100*b*.

Figure 13:
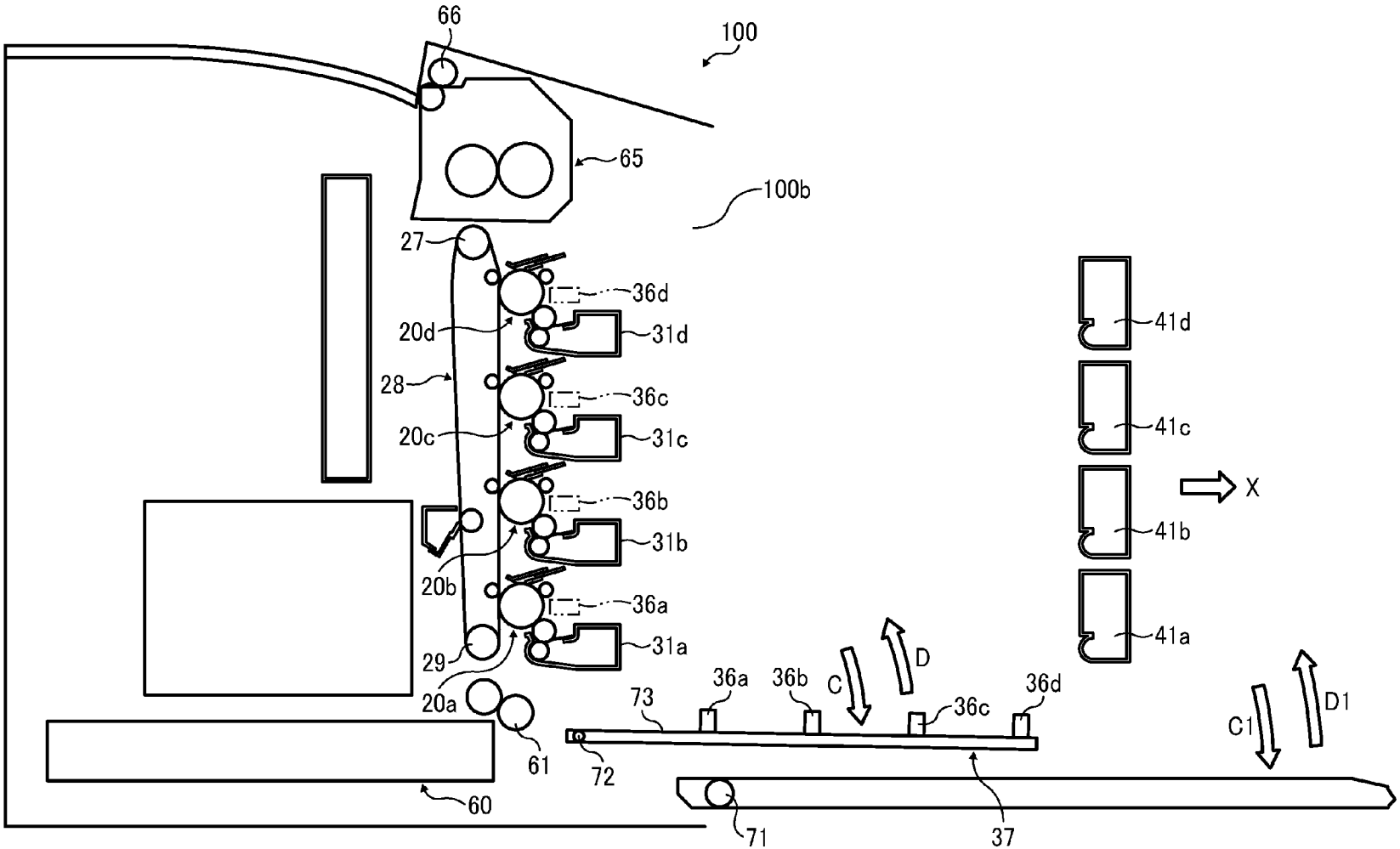
FIG. 13 schematically illustrates an aspect of the image forming apparatus of FIG. 12 when a exposure device deviates from a prescribed position.

Subsequently, the developer containers 41*a*, 41*b*, 41*c*, and 41*d* of FIG. 13 are detached through the opening 100*b* without displacing the LEDs 36*a*, 36*b*, 36*c*, and 36*d* in this situation. Subsequently, when the developing units 31*a*, 31*b*, 31*c*, and 31*d* have been detached through the opening 100*b* in the direction shown by the arrow X (i.e., substantially perpendicular to a lengthwise direction of the photoconductors), the swinging unit 73 is swung around the pivotal shaft 72 in the direction shown by the arrow C, and the LEDs 36*a*, 36*b*, 36*c*, and 36*d* deviate from prescribed functioning positions. Subsequently, the photoconductor units 20*a*, 20*b*, 20*c*, and 20*d* are detached through the opening 100*b* in the direction shown by the arrow X. By contrast, the photoconductor units 20*a*, 20*b*, 20*c*, and 20*d* may be installed by executing opposite operation to the above-described detaching operation.

Hence, the image forming apparatus of FIG. 12 also similarly operates and can obtain the similar result as that of FIG. 1 or the like. Further, the lock mechanism is again preferably included in the image forming apparatus of FIG. 12 only to allow the swinging unit 56 having the LEDs 36*a*, 36*b*, 36*c*, and 36*d* only to swing after the developer containers 41*a*, 41*b*, 41*c*, and 41*d* have deviated.

Although all of the LEDs 36*a*, 36*b*, 36*c*, and 36*d* is simultaneously deviated in the above-described various embodiments as described above, one or more LEDs 36*a*, 36*b*, 36*c*, and 36*d* can be independently displaced between functioning and not functioning positions. With such a modification, each of the LEDs 36*a*, 36*b*, 36*c*, and 36*d* can independently be displaced, thereby improving workability.

Now, an image forming apparatus according to yet another embodiment of the present invention is described with reference to FIGS. 14 to 16. As shown, multiple cleaners 80*a*, 80*b*, 80*c*, and 80*d* and shielding members 81*a-d* are attached to developer containers 41*a*, 41*b*, 41*c*, and 41*d* of the image forming apparatus, respectively.

Typically, the cleaner 80 may be constituted by a sponge member, such as foam polyurethane, foam polyethylene, etc., or a brush roller and the like. The cleaner 80 contacts or is pressed against the charge roller 21 to scrape off toner or paper dust attracted thereonto therefrom when the developer container 41 is typically installed in the apparatus body 100.

Further, the shielding member 81 is composed of a metal or plastic plate. The shielding member 81 is arranged between the cleaner 80 and the LED 36 when the developing container 41 is installed in the apparatus body 100. Consequently, the shielding member 81 suppresses scattering toward the LED 36 of toner or the like scraped off by the cleaner 80. Specifically, the LED may be prevented from stain of the toner or the like.

Further, a pressing member 85 (see FIG. 15) is provided to either make contact of or press the cleaner 80 against the charge member (e.g. a charge roller 21) when the developing container 41 is installed in the apparatus body 100. For this reason, when the body upper cover 51 is closed, the elastic member 86 presses the developer container 41 against the charge roller 21 with its elastic force.

Further, as shown, the LED 36 is arranged between the shielding member 81 and the developing roller 32. Thus, the developer container 41 is positioned on an opposite side (i.e., an upper side in the drawing) of the LED 36 to the photoconductive drum 22 by an angle of about 180 degree from a light emission direction of the light beam emitted therefrom.

Figure 16:
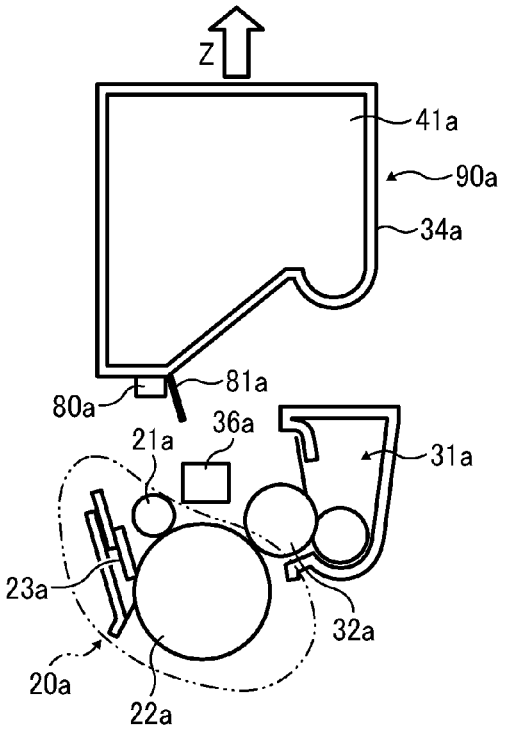
FIG. 16 schematically illustrates an aspect of the image forming apparatus of FIG. 14 when a developer container is being detached therefrom.

Further, when the body upper cover 51 is opened, pressure of the elastic member 86 is released, and the developer container 41 can be ready for detachment in a direction as shown by the arrow Z in FIG. 16. At this moment, the LED does not need to move aside. Further, the developer container 41 detached may be attached again to the apparatus body 100 by inserting it in the opposite direction to that of Z. Also at this moment of the insertion of the developer container 41, the LED 36 does not need to move aside.

Hence, the developer container 41 can be detached as a detachably attachable member 90 substantially perpendicular to the lengthwise direction of the photoconductive member.

Figure 14:
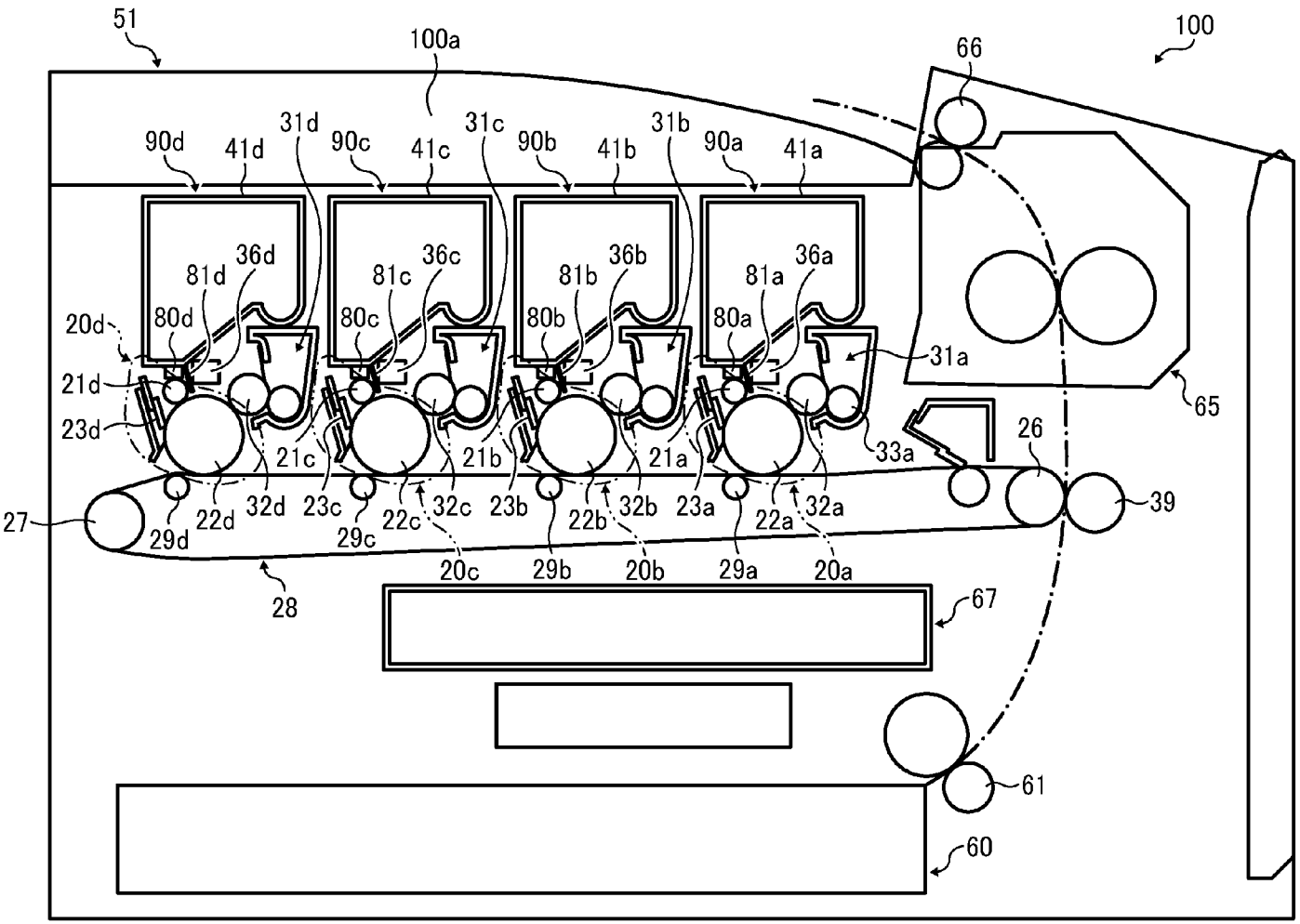
FIG. 14 illustrates the entire configuration of an image forming apparatus according to a sixth embodiment of the present invention.
Figure 15:
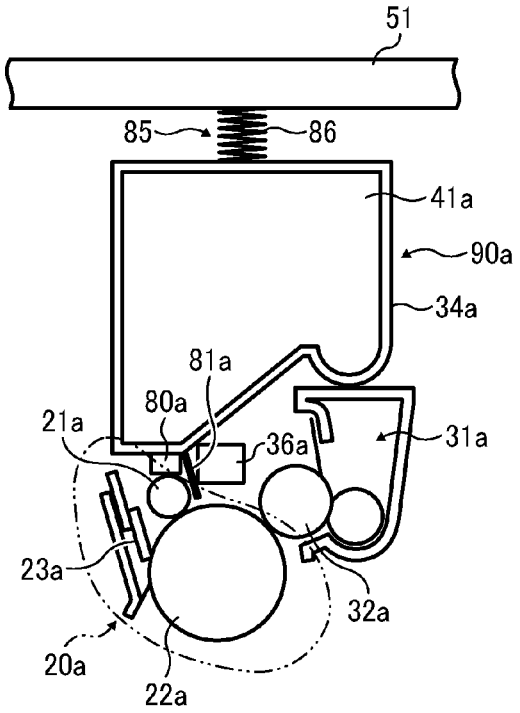
FIG. 15 is an enlarged view schematically illustrating an image forming apparatus of FIG. 14.

According to the image forming apparatus of FIGS. 14 to 16, since the cleaner 80 is integrated with the detachably attachable member 90, a cycle of replacement or maintenance of it becomes shorter than that of the photoconductive member unit 20. Specifically, the cleaner 80 is highly frequently replaced with its cleaning ability living longer even in an image forming apparatus continuously using the same photoconductive member for a ling time period.

Thus, an installation position of the exposure device enables detachment and attachment of the detachably attachable member 90 without displacing the exposure device, so that the detachably attachable member can be stable enabling excellent designing.

Further, with the pressing member 85, the contact or pressing condition of the cleaner 80 against the charge member can be stable improving its cleaning function.

Now, yet another image forming apparatus is described with reference to FIGS. 17 and 18. As shown, in the image forming apparatus on this embodiment, multiple DTMs 42*a*, 42*b*, 42*c*, and 42*d* are formed by integrating developer containers 41*a*, 41*b*, 41*c*, and 41*d* with developing units 31*a*, 31*b*, 31*c*, and 31*d* in units, respectively. Thus, the DTM 42 serves as the detachably attachable member 90. Specifically, a developing roller 32 and a supply roller 33 are installed in a housing 34 of the developer container 41.

The housing 34 of the developer container 41 also includes the cleaner 80 and the shielding member 81. The LED 36 is also arranged between the shielding member 81 and the developing roller 32. Accordingly, the developer container 41 is positioned on an opposite side (i.e., an upper side in the drawing) of the LED 36 to the photoconductive drum 22 by an angle of about 180 degree from a light emission direction the light beam emitted therefrom.

Figure 18:
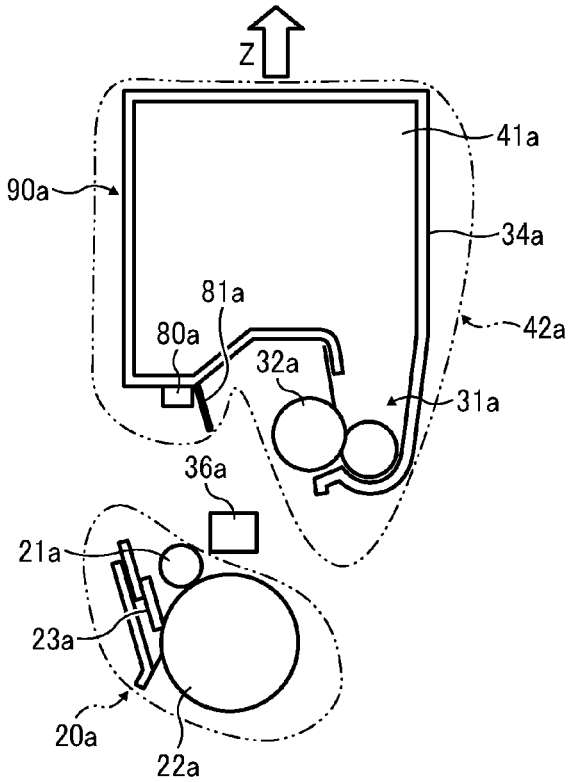
FIG. 18 schematically illustrates an aspect of the image forming apparatus of FIG. 17 when a developer container is being detached therefrom.

Thus, when the body upper cover 51 is opened, pressure of the elastic member 86 is released, and the developer container 41 can be ready for detachment in a direction shown by the arrow Z as shown in FIG. 18. At this moment, the LED 36 again does not need to move aside. Further, the developer container 41 detached may be attached again to the apparatus body 100 if inserting it in the opposite direction to that of Z. At this moment of the insertion of the developing container, the LED 36 does not need to move aside.

Figure 17:
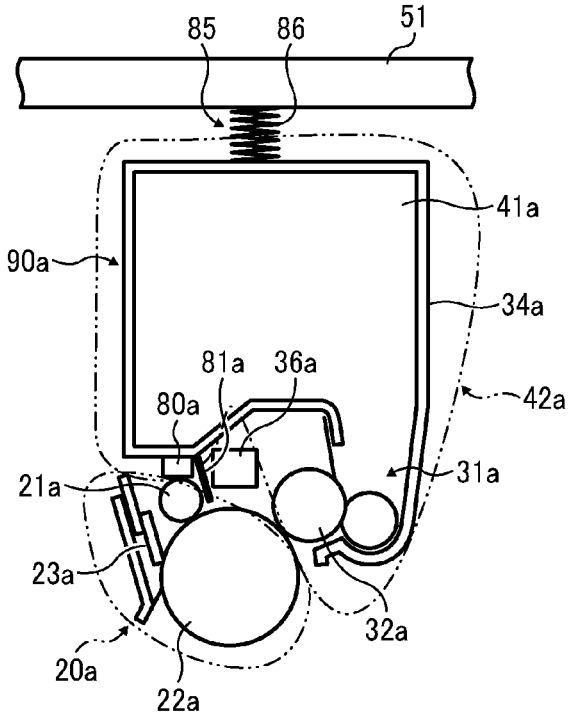
FIG. 17 is an enlarged view schematically illustrating an image forming apparatus of a seventh embodiment according to the present invention.

The image forming apparatus having the detachably attachable member of FIGS. 17 and 18 may operate substantially in the same manner obtaining the same result as that of FIGS. 14 to 16.

Even though it is not shown, but the image forming apparatus of FIGS. 14 and 17 may also preferably include the exposure device displacing mechanism 37 to displace the LED 36 when detaching the photoconductive member unit 20. The exposure device displacing mechanism 37 may be composed of a swingable member 56 that swings around the pivotal shaft 55 as shown in FIG. 1 or the like. Further, the lock mechanism that only allows displacement of the LED 36 only when the detachably attachable member 90 has been detached.

Now, a yet another image forming apparatus is described with reference to FIGS. 19 and 20. As shown, similar to the image forming apparatus of FIG. 12, the photoconductive member units 20 are arranged vertically. For this reason, the multiple developer containers (i.e., toner cartridges) 41, the developing units 31, and an intermediate transfer belt 28 or the like are also vertically arranged.

Also in this embodiment, the cleaner 80 and the shielding member 81 are attached to the housing 34 of the developer container 41. Further, the LED 36 is arranged between the shielding member 81 and the developing roller 32. Accordingly, the developer container 41 is positioned on an opposite side of the LED 36 (i.e., a right side thereof in the drawing) to the photoconductive drum 22 in a direction making an angle of about 180 degree from a light emission direction of the light beam emitted therefrom.

Figure 20:
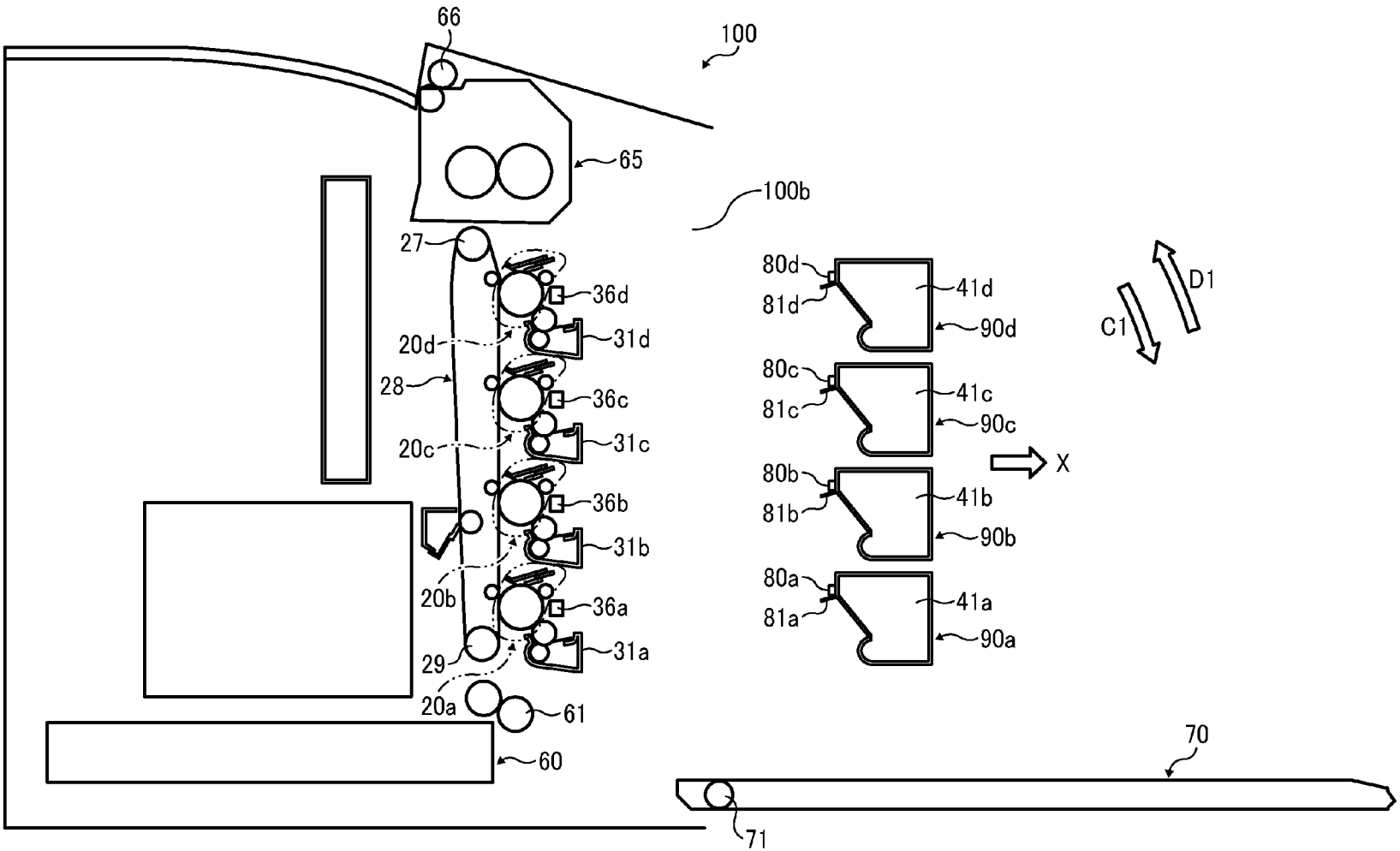
FIG. 20 schematically illustrates an aspect of the image forming apparatus of FIG. 19 when a developer container is being detached therefrom.

Accordingly, by swinging a side wall cover 70 in a direction shown by an arrow C1 and opening one side of the apparatus body as shown in FIG. 20, the developer containers 41*a*, 41*b*, 41*c*, and 41*d* can be drawn in a direction as shown by an arrow X. Further, in a state of opening of one side of the apparatus body as shown in FIG. 20, by inserting the developer container 41 in the opposite direction to that of X, respective developer containers 41*a*, 41*b*, 41*c*, and 41*d* can be installed in the apparatus body 100, by contrast.

Although it is not illustrated, but an elastic member is preferably provided on the side wall cover 70 to press against the developer container 41 in an opposite direction to that shown by the arrow X. With this arrangement of the elastic member, a contact or pressing condition of the cleaner against the charge member can be stable improving a cleaning ability thereof.

Figure 19:
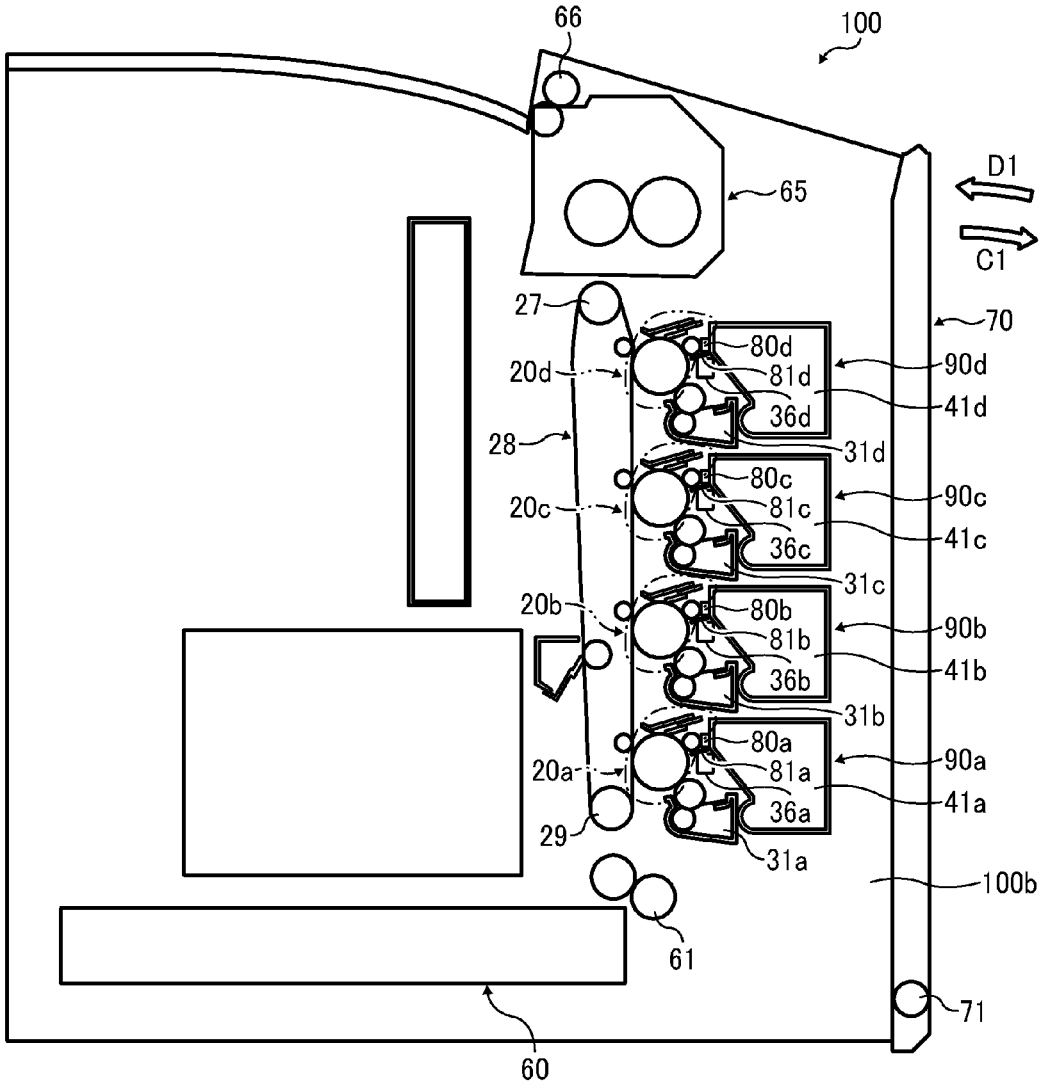
FIG. 19 illustrates the entire configuration of an image forming apparatus according to a eighth embodiment of the present invention.

Hence, the image forming apparatus of FIGS. 19 and 20 can operate substantially in the same way obtaining the same result as that of FIG. 14 or the like. Also in this image forming apparatus of FIGS. 19 and 20, even though it is not illustrated, the exposure device displacing mechanism may preferably displace the LED 36 serving as the exposure device when the photoconductive member unit 20 is to be detached therefrom. The exposure device displacing mechanism may also be constituted by a swingable member 73 swinging via the pivotal shaft 72. The lock mechanism is also preferably provided to allow displacement of the LED 36 only when the developer containers 41*a*, 41*b*, 41*c*, and 41*d* are detached from the image forming apparatus.

Figure 21:
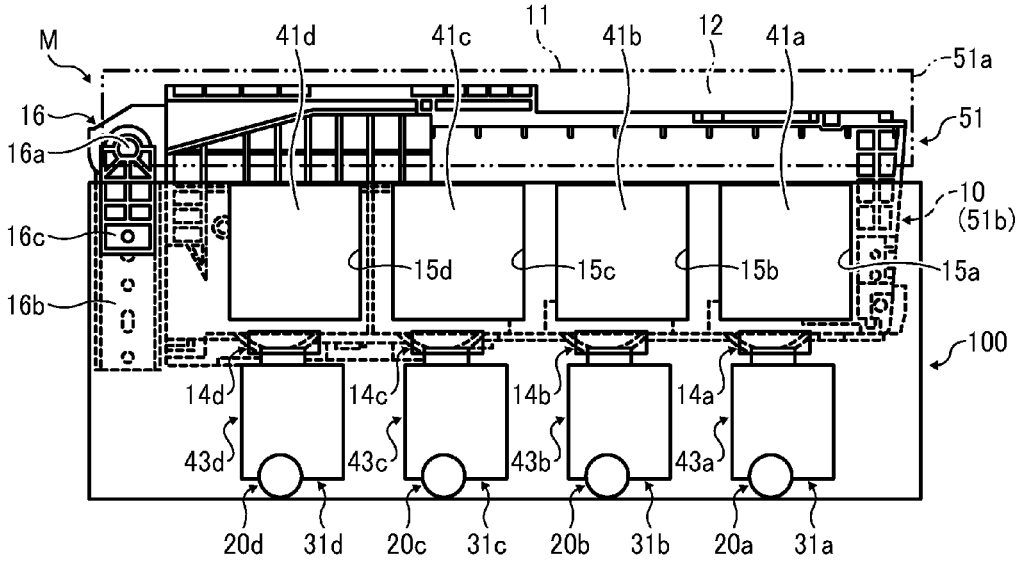
FIG. 21 schematically illustrates an image forming apparatus according to a ninth embodiment of the present invention.
Figure 22:
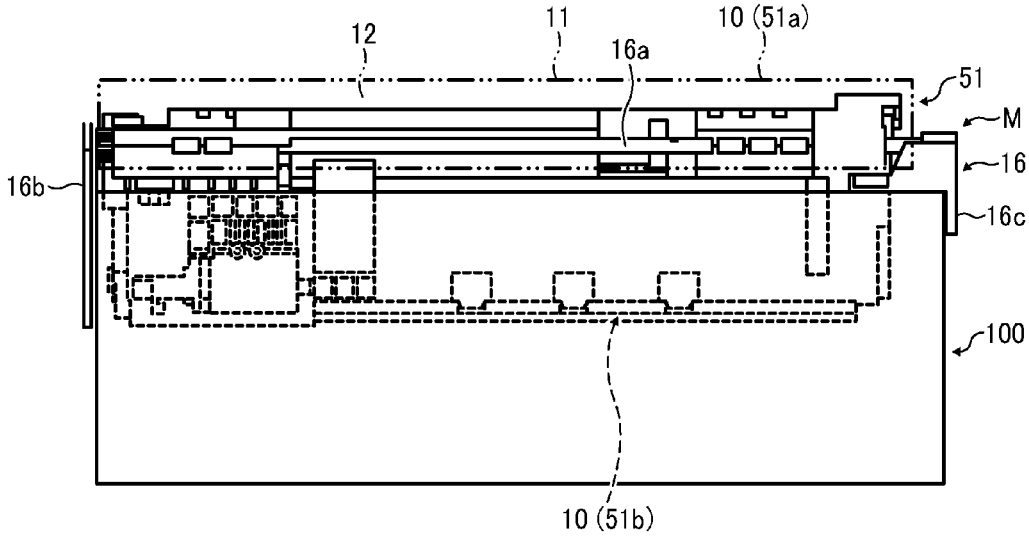
FIG. 22 is a side view illustrating the image forming apparatus of FIG. 21.

Now, yet another image forming apparatus is described with reference to FIGS. 21 and 22. As shown, multiple developer containers 41*a*, 41*b*, 41*c*, and 41*d* are detachably attached to a holder serving as a toner bottle folder cover 10. Further, the body upper cover 51 is attached to the image forming apparatus body 100 to close an upper opening formed thereon. The body upper cover 51 includes outer and inner covers 51*a* and 52*b*.

Figure 23:
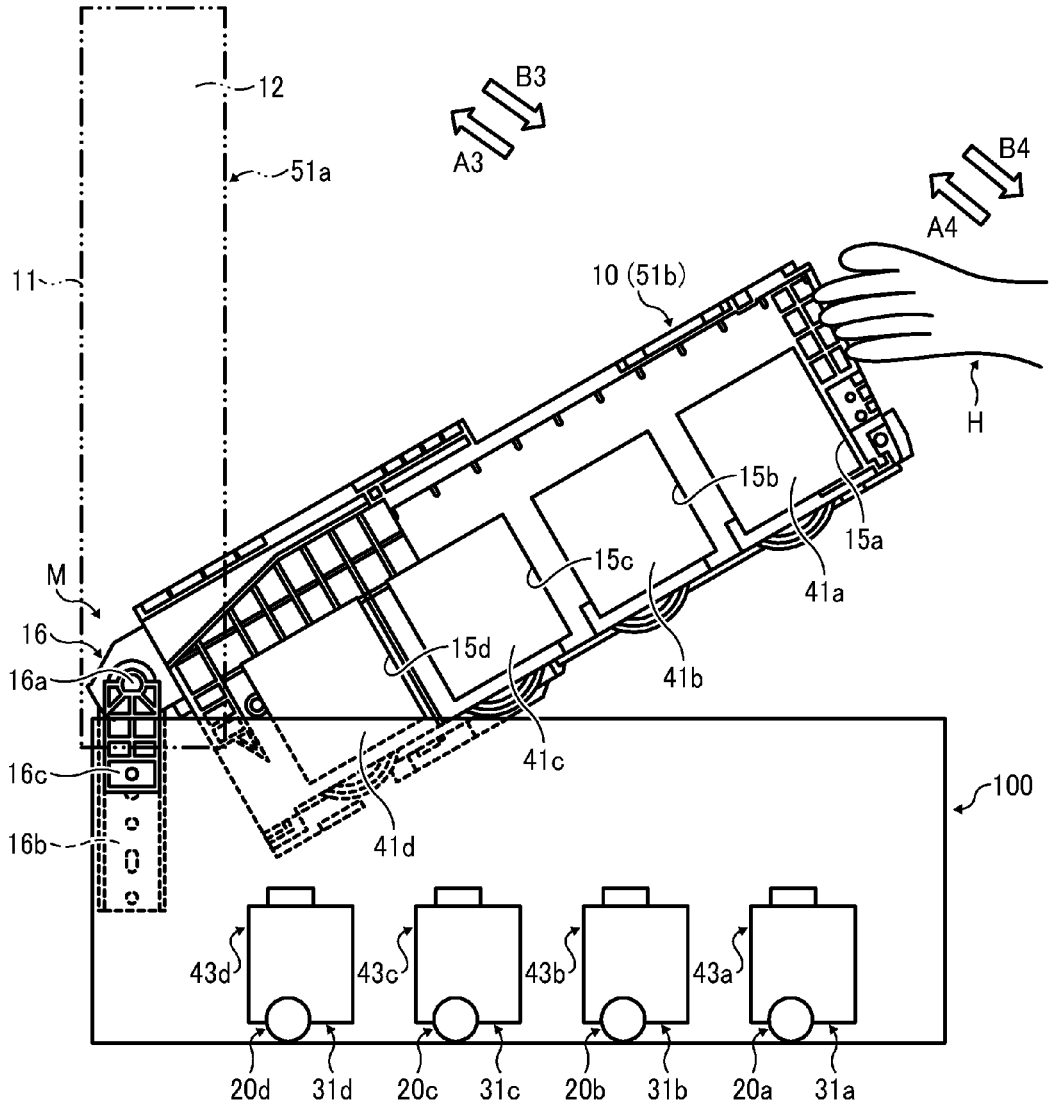
FIG. 23 schematically illustrates one aspect of the image forming apparatus of FIG. 21 when a developer container can be drawn therefrom.

The outer cover 51*a* includes a rectangular upper wall 11 and a peripheral wall 12 dropping from an outer circumferential edge of the upper wall 11. The inner cover 51*b* includes multiple reception chambers 15*a*, 15*b*, 15*c*, and 15*d* in a block as a block member. The respective developer containers 41*a*, 41*b*, 41*c*, and 41*d* are installed in multiple reception chambers 15*a*, 15*b*, 15*c*, and 15*d*, respectively. In this state as shown in FIG. 23, the respective developer containers 41*a*, 41*b*, 41*c*, and 41*d* are drawn in a lengthwise direction of the container and can be detached from the multiple reception chambers 15*a*, 15*b*, 15*c*, and 15*d*, respectively. By contrast, the respective containers 41*a*, 41*b*, 41*c*, and 41*d* can be attached and are installed in the multiple reception chambers 15*a*, 15*b*, 15*c*, and 15*d* in the lengthwise direction of the container, respectively.

As shown, when the body upper cover 51 closes the upper opening of the image forming apparatus body 100, the holder with the developer containers 41*a*, 41*b*, 41*c*, and 41*d* installed therein, and accordingly the inner cover 51*b*, comes to be installed in the outer cover 51*a*. In such an installation state, developer particles stored in the developer containers 41*a*, 41*b*, 41*c*, and 41*d* can be supplied to the photoconductive member units 20*a*, 20*b*, 20*c*, and 20*d* via communication sections 14*a*, 14*b*, 14*c*, and 14*d*, respectively.

Further, the body upper cover 51 is swingably attached to the image forming apparatus body 100 via a displacement mechanism M having a supporter 16. The supporter 16 of the displacing mechanism M includes a pivotal shaft 16*a* and shaft supporters 16*b* and 16*c* attached to the image forming apparatus body 100 to support the pivotal shaft 16*a*. Accordingly, the outer and inner cover 51*a* and 51*b* can swing around the pivotal shaft 16*a* in directions as shown by arrows A3, B3, A4, and B4.

Thus, as shown, when the upper opening of the image forming apparatus body 100 is closed, the developer containers 41*a*, 41*b*, 41*c*, and 41*d* are installed in the image forming apparatus body 100. In this situation, when the outer cover 51*a* is swung in the direction of A3 and is opened, and then the inner cover 51*b* is swung in the direction of A4, the developer containers 41*a*, 41*b*, 41*c*, and 41*d* can be drawn from the image forming apparatus body 100, manually (H) by a user H, for example, as shown.

Hence, by bringing the image forming apparatus body 100 into a drawable state in this way, the developer containers 41*a*, 41*b*, 41*c*, and 41*d* can be separated from the developing units 31*a*, 31*b*, 31*c*, and 31*d* and the photoconductive member units 20*a*, 20*b*, 20*c*, and 20*d* (i.e., the process cartridges 43*a*, 43*b*, 43*c*, and 43*d*).

Consequently, replacement of each of the developer containers 41*a*, 41*b*, 41*c*, and 41*d*, and that of the photoconductive member units 20*a*, 20*b*, 20*c*, and 20*d* (i.e., the process cartridges 43*a*, 43*b*, 43*c*, and 43*d*) can be separately performed from others. During the replacement of each of the developer containers 41*a*, 41*b*, 41*c*, and 41*d*, each of the process cartridges 43*a*, 43*b*, 43*c*, and 43*d* does not interfere therein. Further, during the separate replacement of each of the process cartridges 43*a*, 43*b*, 43*c*, and 43*d*, accordingly each of the photoconductive member units 20*a*, 20*b*, 20*c*, and 20*d*, each of the developer containers 41*a*, 41*b*, 41*c*, and 41*d* does not interfere therein. Hence, workability can be improved.

Since the displacement mechanism M exposes the developer container 41 to an outside upwardly, a large space for replacing the photoconductive member units 20*a*, 20*b*, 20*c*, and 20*d* and the developer containers 41*a*, 41*b*, 41*c*, and 4*d* is not needed. Further, the holder 10 can be swung and take installation and detachable postures under a condition in which the displacement mechanism M is pivotally supported. With the double layer structure, an inner space of the image forming apparatus body 100 can be effectively used. Further, since the inner cover 51*b* can be opened only when the outer cover 51*a* is opened, an erroneous detachment of the developer containers 41*a*, 41*b*, 41*c*, and 41*d* or the like can be suppressed.

With the holder 10, all of the developer containers 41*a*, 41*b*, 41*c*, and 41*d* can be displaced between installation and detachable states. Beside, only a developer container (41*a*, 41*b*, 41*c*, and 41*d*) can be replaced upon need and all of them can be replaced at random.

Numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus comprising:

at least one exposure device serving as a light source to form a latent image on a photoconductor;

at least one developer container to store developer, said at least one developer container being detachably attachable to a main body of the image forming apparatus in a direction perpendicular to a lengthwise direction of the photoconductor;

at least one photoconductor unit having at least a photoconductor to bear a latent image thereon, said photoconductor unit detachably attachable to the main body of the image forming apparatus substantially in the same direction as the developer container;

at least one developing unit to receive developer from the at least one developer container and develop the latent image born on the photoconductor, said at least one developing unit being detachably attachable to the main body of the image forming apparatus substantially in the same direction as the developer container; and an exposure device displacing mechanism to displace the at least one exposure device between a first position enabling the exposure device to function as the light source and a second position disabling the exposure device from functioning as the light source, wherein said at least one photoconductor unit is detached only when the at least one developer container is either displaced from an initial attachment position or is removed from the main body of the image forming apparatus and the at least one exposure device is displaced by the exposure device displacing mechanism from the first to the second positions.

2. The image forming apparatus as claimed in claim 1, wherein said at least one developer container and/or the at least one developing unit is installed on a path along which the at least one exposure device is displaced.

3. The image forming apparatus as claimed in claim 1, wherein said at least one photoconductor unit and the at least one developing unit are separatably integrated into a single unit.

4. The image forming apparatus as claimed in claim 1, wherein said at least one developer container and the at least one developing unit are integrated into a single unit.

5. The image forming apparatus as claimed in claim 1, wherein said exposure device displacing mechanism includes a swinging unit to support and displace the at least one exposure device between the first and second positions.

6. The image forming apparatus as claimed in claim 1, further comprising multiple exposure devices displaceable independently of each other between the first and second positions.

7. An image forming apparatus comprising:

at least one exposure device serving as a light source to form a latent image on a photoconductor;

at least one developer container to store developer;

at least one photoconductor unit having at least a photoconductor to bear a latent image thereon, a charger charging thereof, and a cleaner thereof; and at least one developing unit to receive developer from the at least one developer container and develop the latent image borne on the photoconductor, wherein one of said at least one developer container and a combination of the at least one developer container and the at least one developing unit constituting a detachably attachable member detachably attachable to a main body of the image forming apparatus, wherein said detachably attachable member is inserted and positioned on a rear side of the exposure device in an opposite direct to that of emission of the light beam from the exposure device substantially by the angle of 180 degree.

8. The image forming apparatus as claimed in claim 7, wherein an installation position of the exposure device in the image forming apparatus body does not necessitate displacement of the exposure device to avoid its interference in detaching and attaching operations of the detachably attachable member thereinto.

9. The image forming apparatus as claimed in claim 7, wherein said detachably attachable member includes a pressing member to press the cleaner against the charger when said detachably attachable member is installed in the image forming apparatus body.

10. The image forming apparatus as claimed in claim 7, wherein said detachably attachable member includes a shielding member to shielding the exposure device from the cleaner when said detachably attachable member is installed in the image forming apparatus body.

11. An image forming apparatus comprising:

at least one developer container detachably attached to a main body of the image forming apparatus to store developer;

at least one photoconductor unit detachably attached to a main body of the image forming apparatus having at least a photoconductor to bear a latent image thereon;

at least one developing unit detachably attached to a main body of the image forming apparatus to receive developer from the at least one developer container and develop the latent image borne on the photoconductor;

a holder to hold the at least one developer container; and a displacement mechanism to displace the holder between a first position in which the at least one developer container is installed in the image forming apparatus body and a second position in which it can be detached therefrom, wherein said at least one developer container is separated from the at least one photoconductor unit and allow the at least one photoconductor unit to be detached and attached from and to the image forming apparatus body when the holder is in the second position.

12. The image forming apparatus as claimed in claim 11, wherein said second position is created by exposing the at least one developer container to an outside upwardly from the first position.

13. The image forming apparatus as claimed in claim 11, wherein said displacement mechanism includes a pivotal shaft to swingably support the holder.

14. The image forming apparatus as claimed in claim 11, further comprising:

a body upper cover to close an upper opening of the image forming apparatus, said body upper cover including a double layer structure composed of outer and inner covers, wherein said the inner cover is composed of the holder.

15. The image forming apparatus as claimed in claim 14, wherein said inner cover is openable and closable when the outer cover is opened.

16. The image forming apparatus as claimed in claim 14, wherein said inner cover is openable and closable when the outer cover is opened, and at least two developer containers are separately replaced.

17. The image forming apparatus as claimed in claim 14, wherein said inner cover is openable and closable when the outer cover is opened, and at least two developer containers are separately replaced, wherein said at least two developer containers are separately replaced at random.

18. The image forming apparatus as claimed in claim 11, wherein said holder holds all of at least two developer containers.

* * * * *